US008991072B2

(12) United States Patent
Peyton

(10) Patent No.: US 8,991,072 B2
(45) Date of Patent: Mar. 31, 2015

(54) FLUID-FILLED CHAMBER INCORPORATING A FLEXIBLE PLATE

(75) Inventor: Lee D. Peyton, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 907 days.

(21) Appl. No.: 12/709,786

(22) Filed: Feb. 22, 2010

(65) Prior Publication Data

US 2011/0203133 A1 Aug. 25, 2011

(51) Int. Cl.

| | |
|---|---|
| ***A43B 13/20*** | (2006.01) |
| ***A43B 21/28*** | (2006.01) |
| ***A43B 13/14*** | (2006.01) |
| ***A43B 3/00*** | (2006.01) |
| ***A43B 13/18*** | (2006.01) |

(52) U.S. Cl.

CPC ..... *A43B 13/141* (2013.01); *A43B 13/20* (2013.01); *A43B 3/0057* (2013.01); *A43B 21/28* (2013.01); *A43B 13/181* (2013.01); *A43B 13/189* (2013.01)

USPC ..... 36/29; 36/35 B; 36/107

(58) Field of Classification Search

CPC .. A43B 3/0057; A43B 13/141; A43B 13/181; A43B 13/20; A43B 17/03; A43B 21/28

USPC ..... 36/28, 29, 35 B, 107, 153

See application file for complete search history.

(56) References Cited

U.S. PATENT DOCUMENTS

| | | | | |
|---|---|---|---|---|
| 2,677,906 | A | | 5/1954 | Reed |
| 2,703,770 | A | | 3/1955 | Melzer |
| 3,030,640 | A | | 4/1962 | Gosman |
| 3,608,215 | A | | 9/1971 | Fukuoka |
| 3,685,176 | A | | 8/1972 | Rudy |
| 3,758,964 | A | | 9/1973 | Nishimura |
| 4,059,910 | A | * | 11/1977 | Bryden et al. ..... 36/103 |
| 4,183,156 | A | | 1/1980 | Rudy |
| 4,187,620 | A | | 2/1980 | Selner |
| 4,217,705 | A | | 8/1980 | Donzis |
| 4,219,945 | A | | 9/1980 | Rudy |
| 4,340,626 | A | | 7/1982 | Rudy |
| 4,358,902 | A | | 11/1982 | Cole et al. |
| 4,476,638 | A | * | 10/1984 | Quacquarini et al. ..... 36/86 |
| 4,506,460 | A | | 3/1985 | Rudy |
| 4,547,919 | A | | 10/1985 | Wang |
| 4,698,864 | A | | 10/1987 | Graebe |

(Continued)

FOREIGN PATENT DOCUMENTS

| | | |
|---|---|---|
| EP | 1929893 | 6/2008 |
| GB | 2251368 | 7/1992 |
| WO | 9000021 | 1/1990 |

OTHER PUBLICATIONS

International Search Report and Written Opinion mailed Jul. 11, 2011 in International Application No. PCT/US2011/023779.

*Primary Examiner* — Khoa Huynh
*Assistant Examiner* — Sharon M Prange
(74) *Attorney, Agent, or Firm* — Plumsea Law Group, LLC

(57) ABSTRACT

A fluid-filled chamber may include including an outer barrier, a plate having indentations, and a fluid. The plate may be located within barrier and secured to an inner surface of the barrier. The fluid is also located within the barrier and pressurized to place an outward force upon the barrier. The indentations in the plate may permit flexing of the plate in one direction while obstructing flexing of the plate in another direction. Accordingly, the plate may enhance shape-retention properties of the chamber while also enhancing an overall transparency of the chamber.

38 Claims, 29 Drawing Sheets

(56) References Cited

U.S. PATENT DOCUMENTS

| | | | | |
|---|---|---|---|---|
| 4,722,131 | A | 2/1988 | Huang | |
| 4,779,361 | A * | 10/1988 | Kinsaul | 36/102 |
| 4,782,602 | A | 11/1988 | Lakic | |
| 4,803,029 | A | 2/1989 | Iversen et al. | |
| 4,817,304 | A | 4/1989 | Parker et al. | |
| 4,823,482 | A | 4/1989 | Lakic | |
| 4,845,861 | A | 7/1989 | Moumdjian | |
| 4,874,640 | A | 10/1989 | Donzis | |
| 4,891,855 | A | 1/1990 | Cheng-Chung | |
| 4,906,502 | A | 3/1990 | Rudy | |
| 4,912,861 | A | 4/1990 | Huang | |
| 4,936,029 | A | 6/1990 | Rudy | |
| 4,991,317 | A | 2/1991 | Lakic | |
| 4,999,931 | A | 3/1991 | Vermeulen | |
| 5,022,109 | A | 6/1991 | Pekar | |
| 5,025,575 | A | 6/1991 | Lakic | |
| 5,042,176 | A | 8/1991 | Rudy | |
| 5,044,030 | A | 9/1991 | Balaton | |
| 5,158,767 | A | 10/1992 | Cohen et al. | |
| 5,179,792 | A | 1/1993 | Brantingham | |
| 5,193,246 | A | 3/1993 | Huang | |
| 5,199,191 | A | 4/1993 | Moumdjian | |
| 5,224,277 | A | 7/1993 | Sang Do | |
| 5,224,278 | A | 7/1993 | Jeon | |
| 5,228,156 | A | 7/1993 | Wang | |
| 5,235,715 | A | 8/1993 | Donzis | |
| 5,245,766 | A | 9/1993 | Warren | |
| 5,253,435 | A | 10/1993 | Auger et al. | |
| 5,257,470 | A | 11/1993 | Auger et al. | |
| 5,335,382 | A | 8/1994 | Huang | |
| 5,337,492 | A | 8/1994 | Anderie et al. | |
| 5,353,459 | A | 10/1994 | Potter et al. | |
| 5,367,791 | A | 11/1994 | Gross et al. | |
| 5,406,719 | A | 4/1995 | Potter | |
| 5,493,792 | A | 2/1996 | Bates et al. | |
| 5,572,804 | A | 11/1996 | Skaja et al. | |
| 5,592,706 | A | 1/1997 | Pearce | |
| 5,595,004 | A | 1/1997 | Lyden et al. | |
| 5,669,161 | A | 9/1997 | Huang | |
| 5,686,167 | A | 11/1997 | Rudy | |
| 5,704,137 | A | 1/1998 | Dean et al. | |
| 5,713,141 | A | 2/1998 | Mitchell | |
| 5,741,568 | A | 4/1998 | Rudy | |
| 5,771,606 | A | 6/1998 | Litchfield et al. | |
| 5,832,630 | A | 11/1998 | Potter | |
| 5,846,063 | A | 12/1998 | Lakic | |
| 5,907,911 | A | 6/1999 | Huang | |
| 5,916,664 | A | 6/1999 | Rudy | |
| 5,925,306 | A | 7/1999 | Huang | |
| 5,952,065 | A | 9/1999 | Mitchell et al. | |
| 5,976,451 | A | 11/1999 | Skaja et al. | |
| 5,979,078 | A | 11/1999 | McLaughlin | |
| 5,993,585 | A | 11/1999 | Goodwin et al. | |
| 6,009,637 | A | 1/2000 | Pavone | |
| 6,013,340 | A | 1/2000 | Bonk et al. | |
| 6,027,683 | A | 2/2000 | Huang | |
| 6,029,962 | A | 2/2000 | Shorten et al. | |
| 6,065,150 | A | 5/2000 | Huang | |
| 6,082,025 | A | 7/2000 | Bonk et al. | |
| 6,098,313 | A | 8/2000 | Skaja | |
| 6,127,010 | A | 10/2000 | Rudy | |
| 6,127,026 | A | 10/2000 | Bonk et al. | |
| 6,128,837 | A | 10/2000 | Huang | |
| 6,192,606 | B1 | 2/2001 | Pavone | |
| 6,203,868 | B1 | 3/2001 | Bonk et al. | |
| 6,205,682 | B1 * | 3/2001 | Park | 36/29 |
| 6,253,466 | B1 | 7/2001 | Harmon-Weiss et al. | |
| 6,258,421 | B1 | 7/2001 | Potter | |
| 6,321,465 | B1 | 11/2001 | Bonk et al. | |
| 6,374,514 | B1 | 4/2002 | Swigart | |
| 6,385,864 | B1 | 5/2002 | Sell, Jr. et al. | |
| 6,402,879 | B1 | 6/2002 | Tawney et al. | |
| 6,430,843 | B1 | 8/2002 | Potter et al. | |
| 6,457,262 | B1 | 10/2002 | Swigart | |
| 6,463,612 | B1 | 10/2002 | Potter | |
| 6,550,085 | B2 | 4/2003 | Roux | |
| 6,571,490 | B2 | 6/2003 | Tawney et al. | |
| 6,665,958 | B2 | 12/2003 | Goodwin | |
| 6,783,184 | B2 | 8/2004 | DiBattista et al. | |
| 6,796,056 | B2 | 9/2004 | Swigart | |
| 6,837,951 | B2 | 1/2005 | Rapaport | |
| 6,892,477 | B2 | 5/2005 | Potter et al. | |
| 6,918,198 | B2 | 7/2005 | Chi | |
| 6,931,764 | B2 | 8/2005 | Swigart et al. | |
| 6,971,193 | B1 | 12/2005 | Potter et al. | |
| 7,000,335 | B2 | 2/2006 | Swigart et al. | |
| 7,051,456 | B2 | 5/2006 | Swigart et al. | |
| 7,070,845 | B2 | 7/2006 | Thomas et al. | |
| 7,076,891 | B2 | 7/2006 | Goodwin | |
| 7,086,179 | B2 | 8/2006 | Dojan et al. | |
| 7,128,796 | B2 | 10/2006 | Hensley et al. | |
| 7,131,218 | B2 | 11/2006 | Schindler | |
| 7,141,131 | B2 | 11/2006 | Foxen | |
| 7,200,957 | B2 | 4/2007 | Hubbard et al. | |
| 7,244,483 | B2 | 7/2007 | Tawney et al. | |
| 7,451,554 | B2 | 11/2008 | Hazenberg et al. | |
| 7,533,477 | B2 | 5/2009 | Goodwin et al. | |
| 7,555,848 | B2 | 7/2009 | Aveni et al. | |
| 7,555,851 | B2 | 7/2009 | Hazenberg et al. | |
| 8,522,457 | B2 * | 9/2013 | Scholz et al. | 36/102 |
| 2002/0016733 | A1 | 2/2002 | Ito | |
| 2005/0241184 | A1 | 11/2005 | LeVert et al. | |
| 2009/0151193 | A1 | 6/2009 | Moon et al. | |
| 2009/0151196 | A1 | 6/2009 | Schindler et al. | |

* cited by examiner

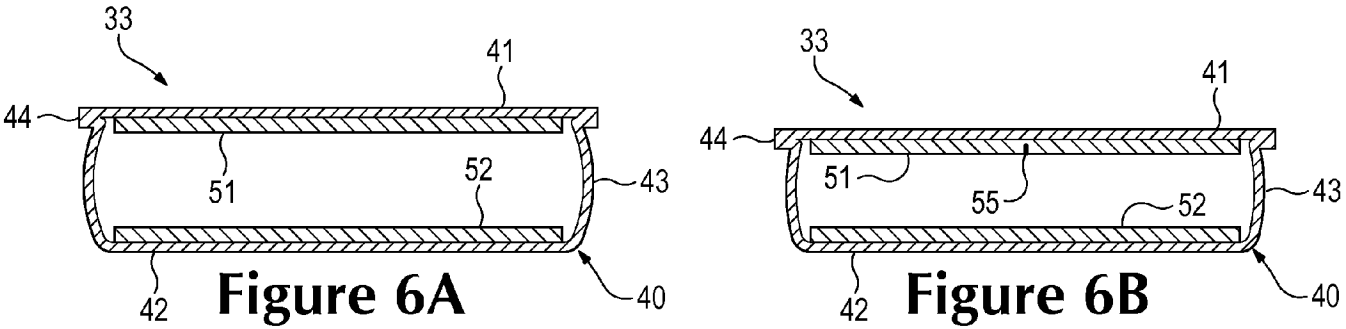
Figure 6A
Figure 6B
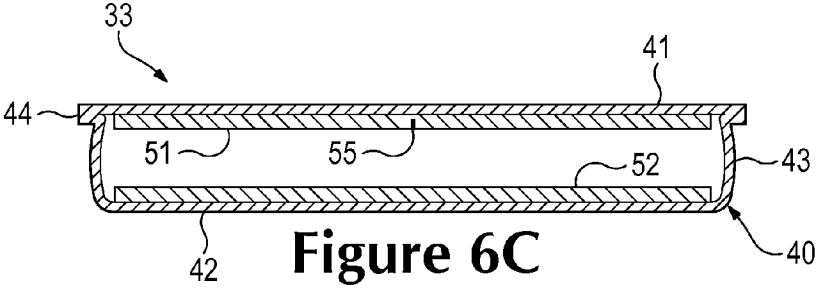
Figure 6C
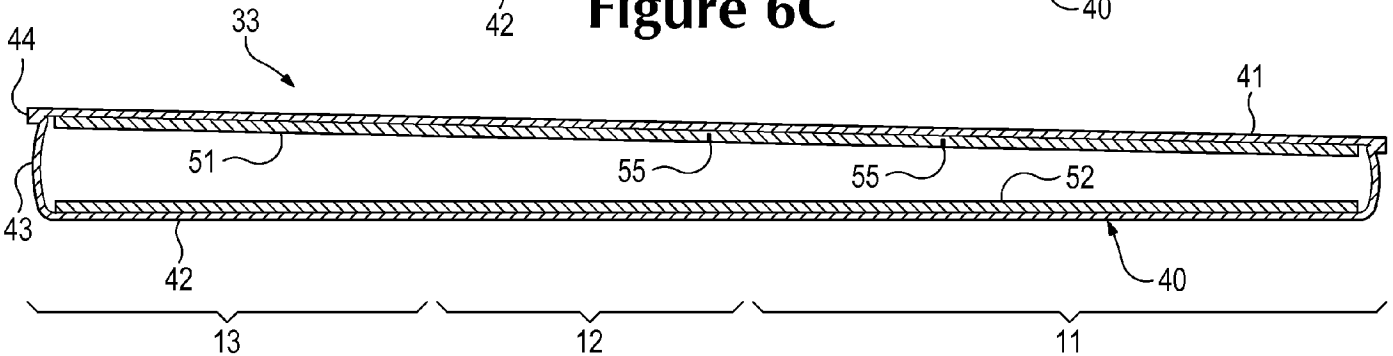
Figure 6D

FLUID-FILLED CHAMBER INCORPORATING A FLEXIBLE PLATE

BACKGROUND

Articles of footwear generally include two primary elements, an upper and a sole structure. The upper is formed from a variety of material elements (e.g., textiles, foam, leather, and synthetic leather) that are stitched or adhesively bonded together to form a void on the interior of the footwear for comfortably and securely receiving a foot. An ankle opening through the material elements provides access to the void, thereby facilitating entry and removal of the foot from the void. In addition, a lace is utilized to modify the dimensions of the void and secure the foot within the void.

The sole structure is located adjacent to a lower portion of the upper and is generally positioned between the foot and the ground. In many articles of footwear, including athletic footwear, the sole structure generally incorporates an insole, a midsole, and an outsole. The insole, which may be located within the void and adjacent to a lower surface of the void, is a thin compressible member that enhances footwear comfort. The midsole, which may be secured to a lower surface of the upper and extends downward from the upper, forms a middle layer of the sole structure. In addition to attenuating ground reaction forces (i.e., providing cushioning for the foot), the midsole may limit foot motions or impart stability, for example. The outsole, which may be secured to a lower surface of the midsole, forms the ground-contacting portion of the footwear and is usually fashioned from a durable and wear-resistant material that includes texturing to improve traction.

Generally, the midsole is primarily formed from a foamed polymer material, such as polyurethane or ethylvinylacetate, that extends throughout a length and width of the footwear. In some articles of footwear, the midsole may include a variety of additional footwear elements that enhance the comfort or performance of the footwear, including plates, moderators, fluid-filled chambers, lasting elements, or motion control members. In some configurations, any of these additional footwear elements may be located between the midsole and either of the upper and outsole, embedded within the midsole, or encapsulated by the foamed polymer material of the midsole, for example. Although many midsoles are primarily formed from a foamed polymer material, fluid-filled chambers or other non-foam structures may form a majority of some midsole configurations.

Various techniques may be utilized to form fluid-filled chambers for articles of footwear or other products, including a two-film technique, a thermoforming technique, and a blowmolding technique, for example. In the two-film technique, two separate polymer sheets are bonded together at specific locations. The thermoforming technique is similar to the two-film technique in that two polymer sheets are bonded together, but also includes utilizing a heated mold to form or otherwise shape the polymer sheets. In the blow-molding technique, a parison formed from a molten or otherwise softened polymer material is placed within a mold having a cavity with the desired configuration of the chamber. Pressurized air induces the polymer material to conform to surfaces of the cavity. The polymer material then cools and retains the shape of the cavity, thereby forming the chamber.

Following each of the techniques discussed above, the chambers are pressurized. That is, a pressurized fluid is injected into the chambers and then sealed within the chambers. One method of pressurization involves forming inflation conduits in residual portions of the polymer sheets or the parison. In order to pressurize the chambers, the fluid is injected through the inflation conduits, which are then sealed. The residual portions of the polymer sheets or the parison, including the inflation conduits, are then trimmed or otherwise removed to substantially complete manufacture of the chambers.

SUMMARY

Various features of a fluid-filled chamber, which may be incorporated into articles of footwear and other products, are disclosed below. In one configuration, a fluid-filled structure comprises a chamber and a plate. The chamber has an exterior surface and an interior surface located opposite the exterior surface. At least a portion of the interior surface defines a cavity within the chamber that receives a fluid. The plate has a first surface secured to the chamber and a second surface located opposite the first surface. At least the second surface defines a flexion area extending across at least a portion of the plate. The second surface also defines a flexion stop located adjacent to the flexion area.

In another configuration, a fluid-filled structure comprises a chamber and a plate. The chamber has an exterior surface and an interior surface located opposite the exterior surface. At least a portion of the interior surface defines a cavity within the chamber that receives a fluid. The plate is located within the cavity. The plate has a first surface secured to the chamber and a second surface located opposite the first surface. The second surface defines an indentation extending into and across at least a portion of the plate. The second surface also defines edge areas located immediately adjacent to the indentation and on opposite sides of the indentation. At least a portion of the edge areas has an interlocking configuration.

In a further configuration, an article of footwear has an upper and a sole structure secured to the upper. The sole structure comprises a chamber and a plate. The chamber has an exterior surface and an interior surface located opposite the exterior surface. At least a portion of the interior surface defines a cavity within the chamber that receives a fluid. The plate is located within the cavity. The plate has a first surface secured to the interior of the chamber and a second surface located opposite the first surface. The second surface defines an indentation extending into and across at least a portion of the plate.

In yet another configuration, an article of footwear has an upper and a sole structure secured to the upper. The sole structure comprises a chamber and a plate. The chamber defines an interior cavity that receives a pressurized fluid. The chamber extends from a heel region of the footwear to a forefoot region of the footwear and from a lateral side of the footwear to a medial side of the footwear. The chamber has an upper portion, a lower portion, and a sidewall portion. The upper portion forms an upper surface of the chamber and is positioned adjacent to the upper. The lower portion forms an opposite lower surface of the chamber and is positioned adjacent to a ground-contacting surface of the sole structure. The sidewall portion extends between the upper portion and the lower portion to form a sidewall of the chamber. The plate is secured to the upper portion of the chamber. The plate extends from the heel region to the forefoot region and from the lateral side to the medial side. The plate has a first area and a second area located on opposite sides of a flexion line. The first area rotates relative to the second area about the flexion line.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

FIGS. 6A-6D are cross-sectional views of the chamber, as defined by section lines 6A-6D in FIG. 5.

DETAILED DESCRIPTION

The following discussion and accompanying figures disclose various configurations of fluid-filled chambers and methods for manufacturing the chambers. Although the chambers are disclosed with reference to footwear having a configuration that is suitable for running, concepts associated with the chambers may be applied to a wide range of athletic footwear styles, including basketball shoes, cross-training shoes, football shoes, golf shoes, hiking shoes and boots, ski and snowboarding boots, soccer shoes, tennis shoes, and walking shoes, for example. Concepts associated with the chambers may also be utilized with footwear styles that are generally considered to be non-athletic, including dress shoes, loafers, and sandals. In addition to footwear, the chambers may be incorporated into other types of apparel and athletic equipment, including helmets, gloves, and protective padding for sports such as football and hockey. Similar chambers may also be incorporated into cushions and other compressible structures utilized in household goods and industrial products. Accordingly, chambers incorporating the concepts disclosed herein may be utilized with a variety of products.

General Footwear Structure

Figure 1:
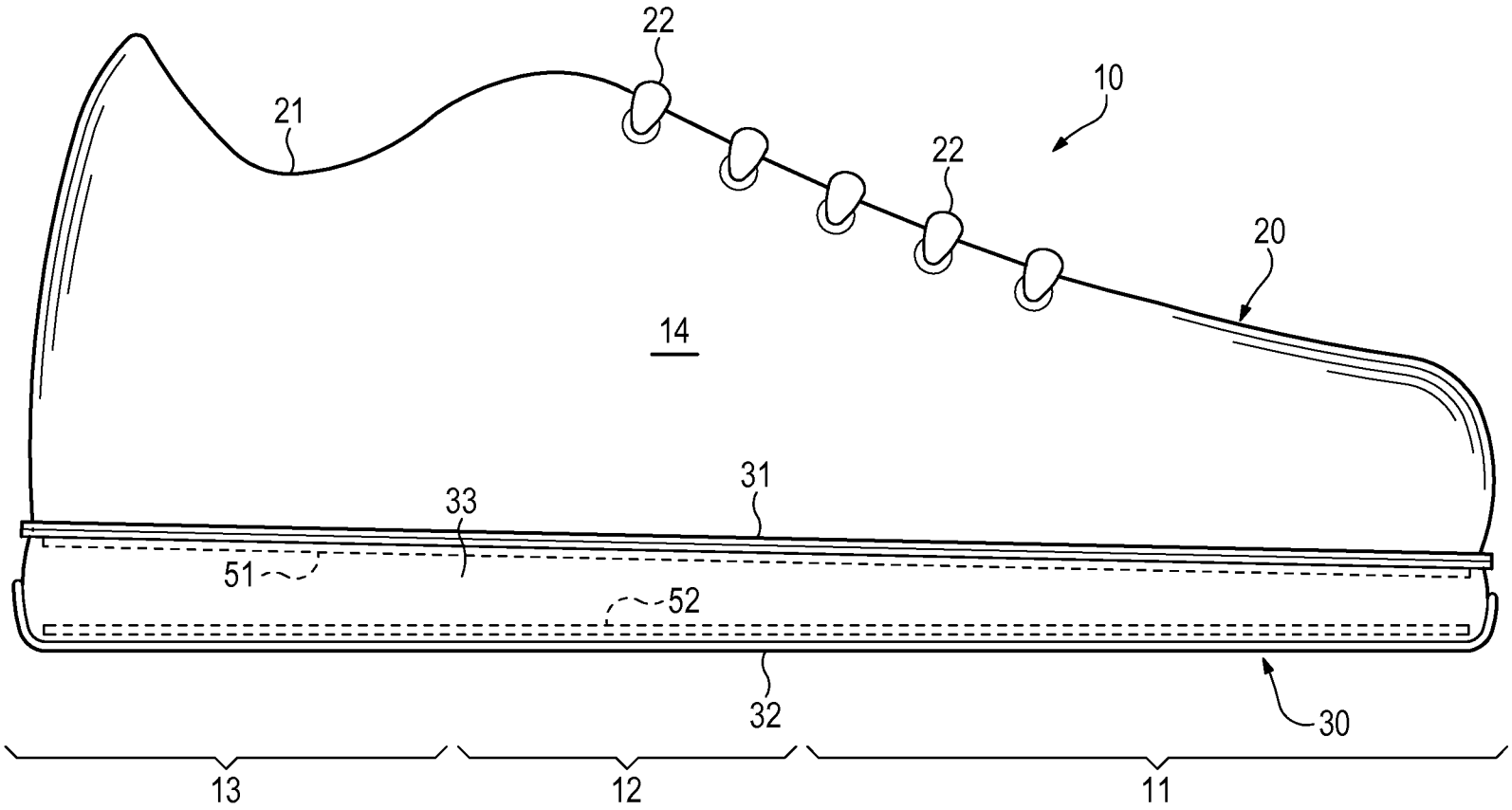
FIG. 1 is a lateral side elevational view of an article of footwear.
Figure 2:
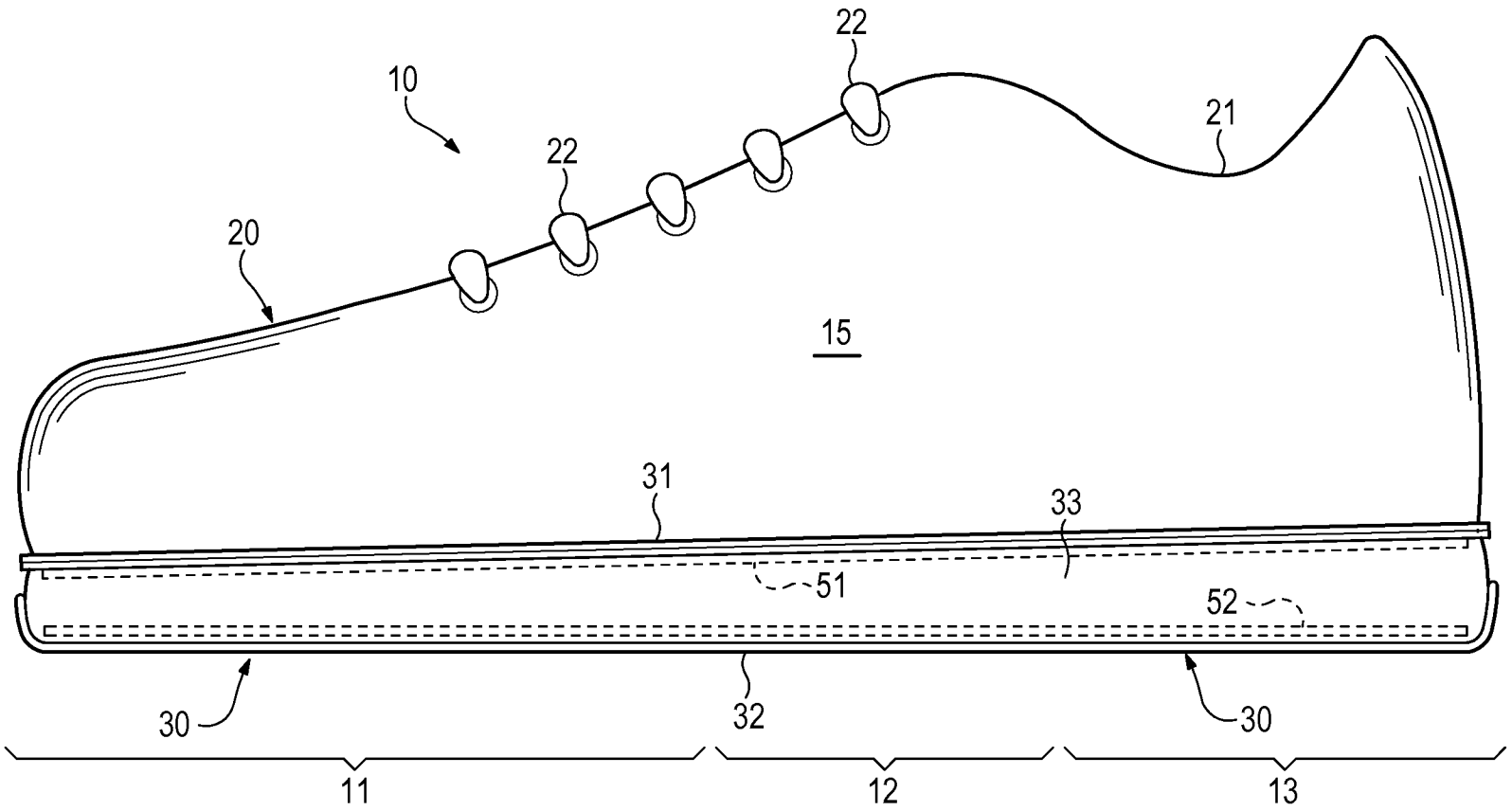
FIG. 2 is a medial side elevational view of the article of footwear.
Figure 3:
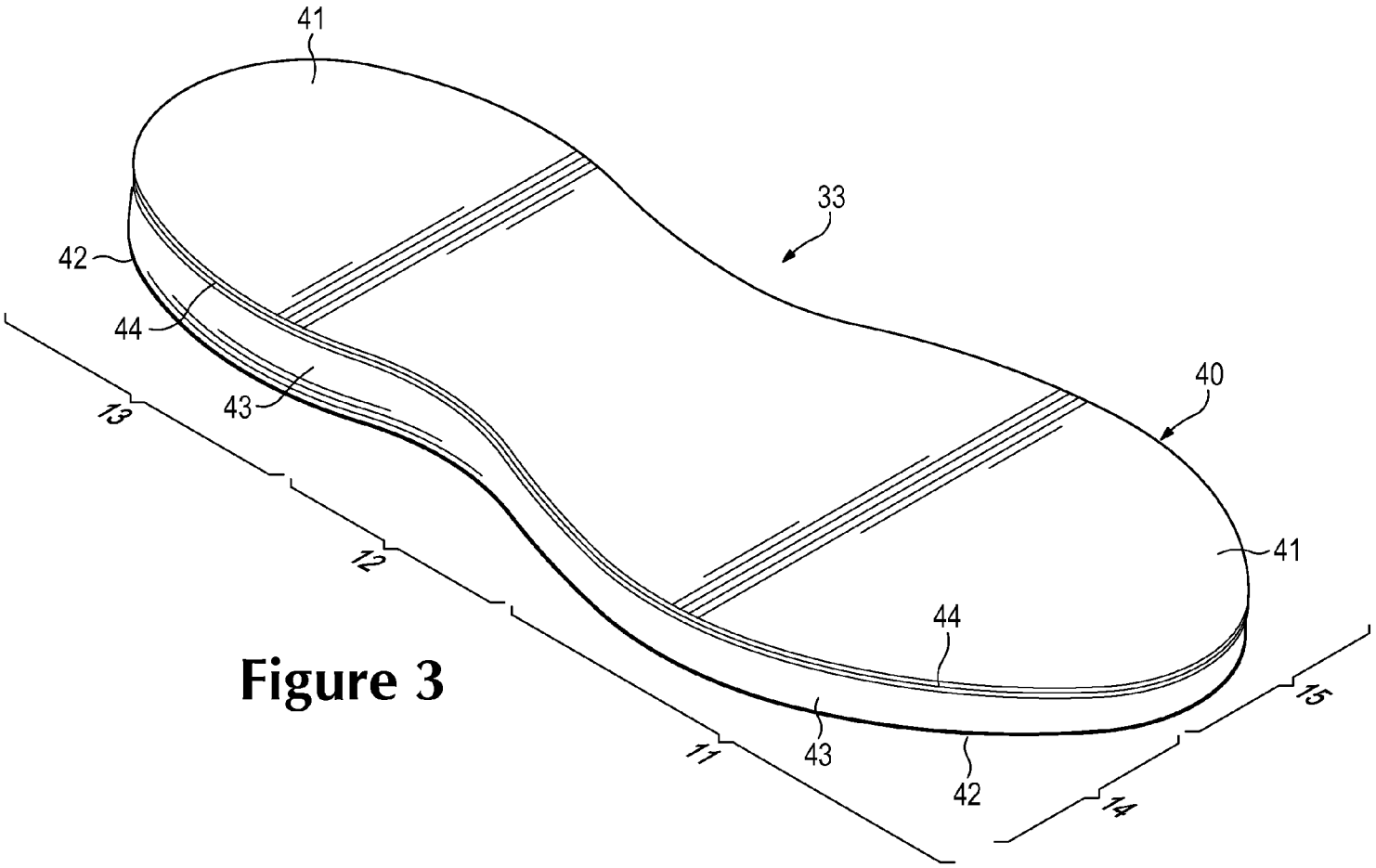
FIG. 3 is a perspective view of a chamber from the article of footwear.
Figure 4:
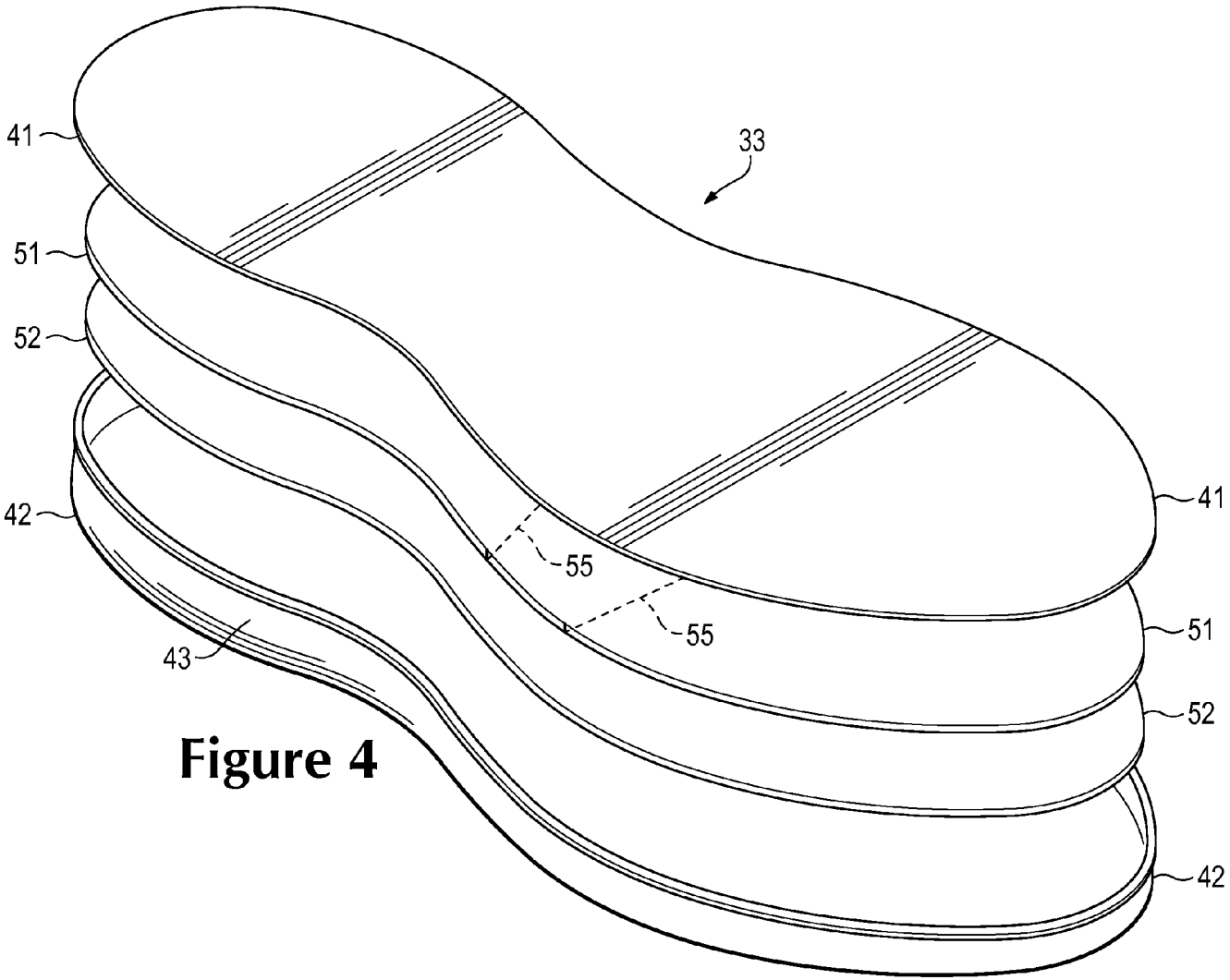
FIG. 4 is an exploded perspective view of the chamber.
Figure 5:
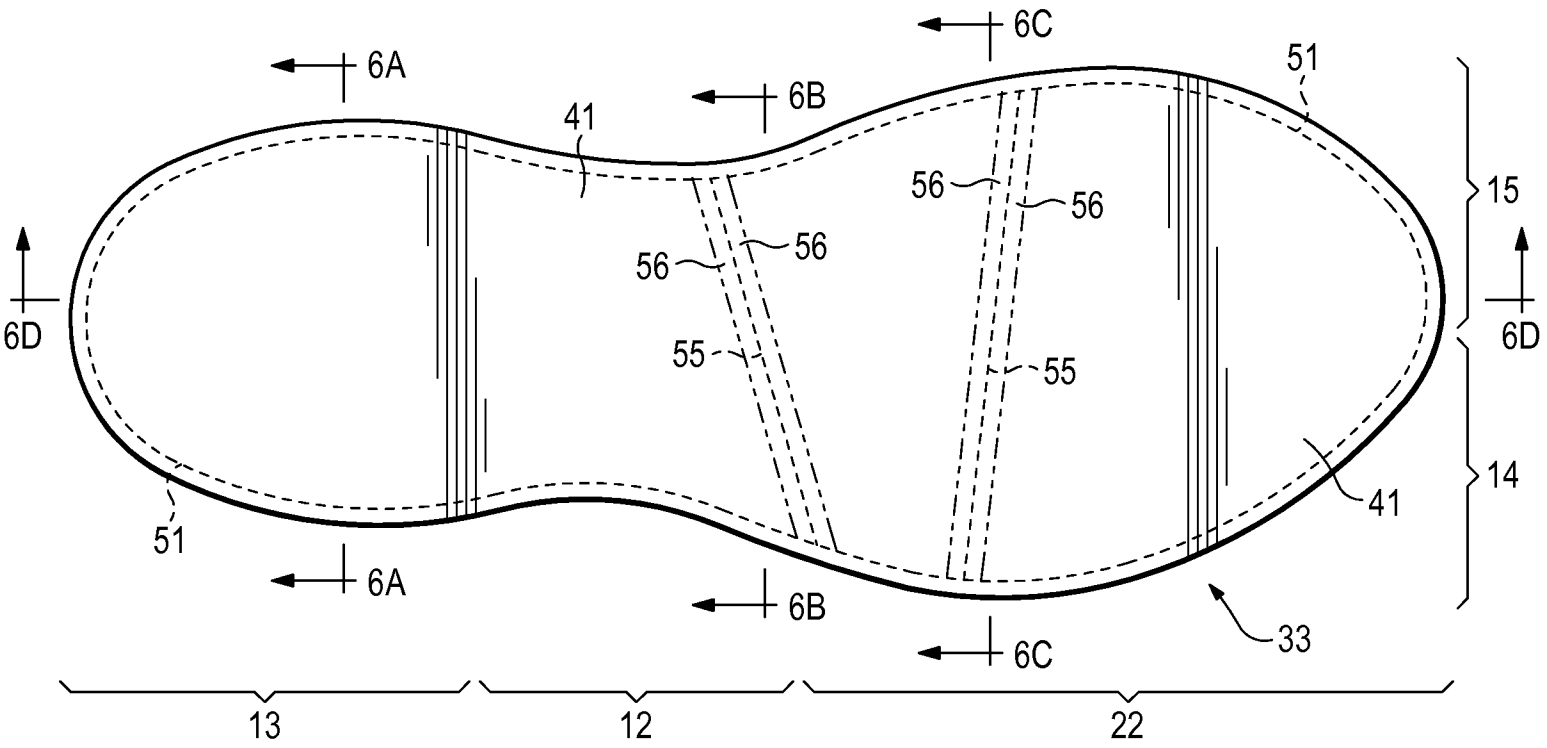
FIG. 5 is a top plan view of the chamber.
Figure 7:
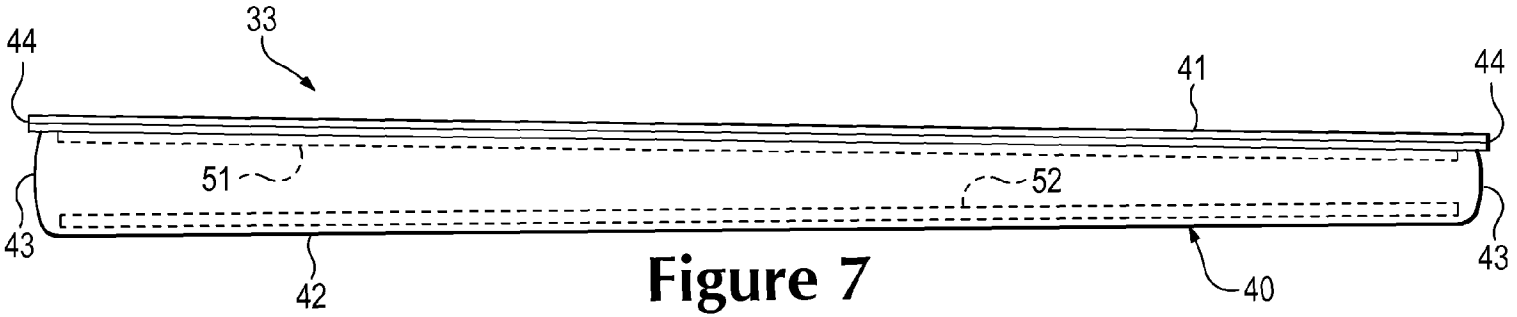
FIG. 7 is a lateral side elevational view of the chamber.
Figure 8:
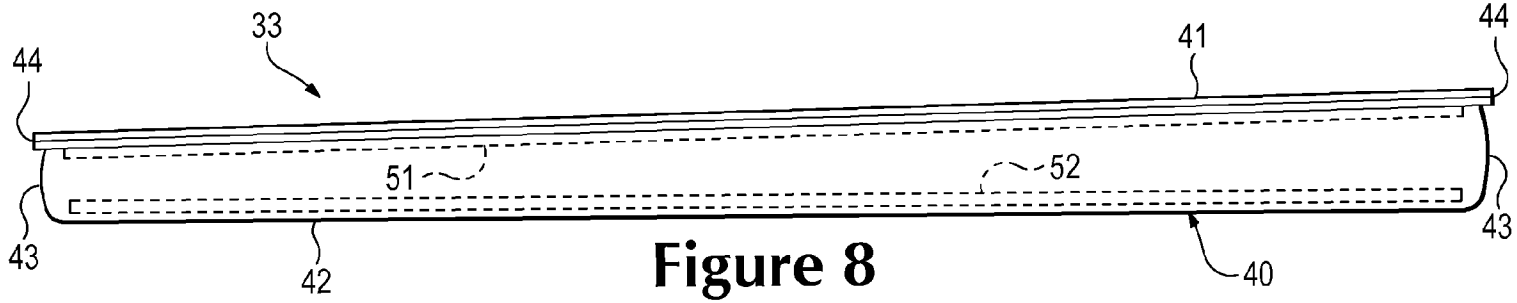
FIG. 8 is a medial side elevational view of the chamber.
Figure 9:
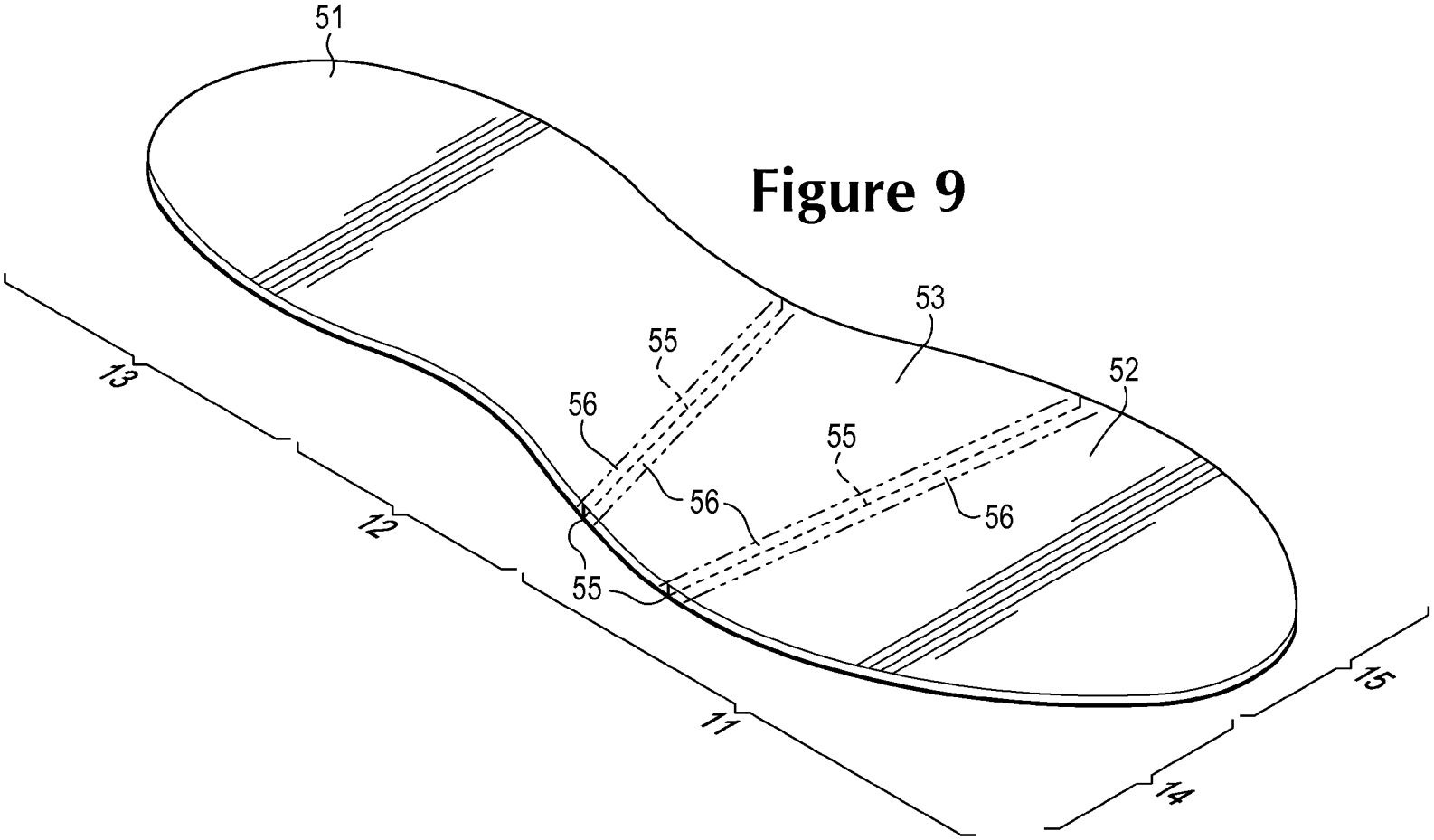
FIG. 9 is a perspective view of an upper plate of the chamber.
Figure 10:
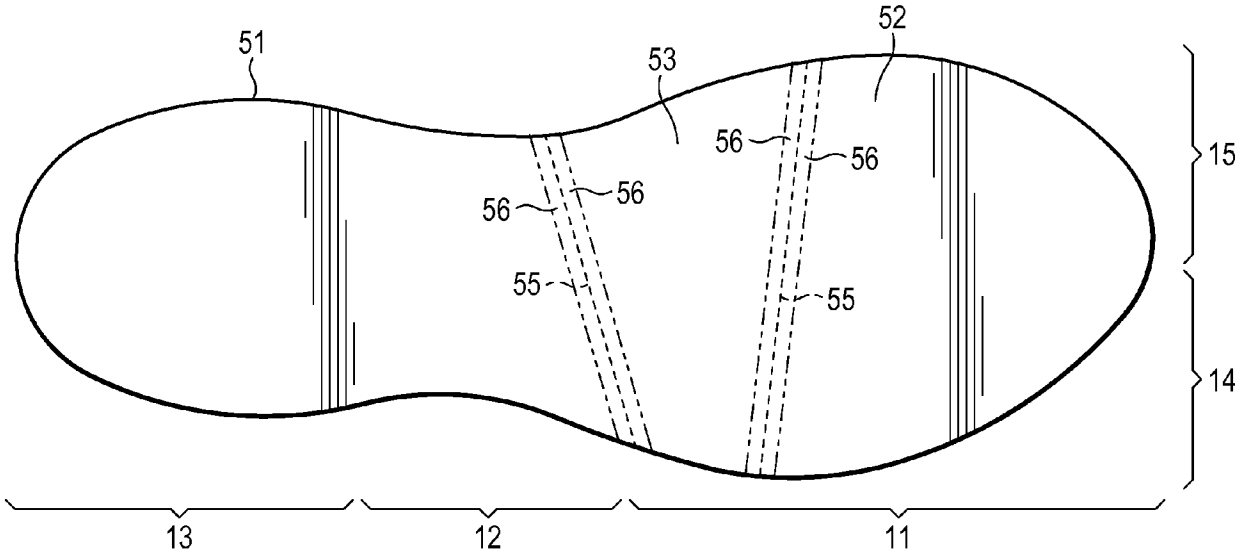
FIG. 10 is a top plan view of the upper plate.
Figure 11:
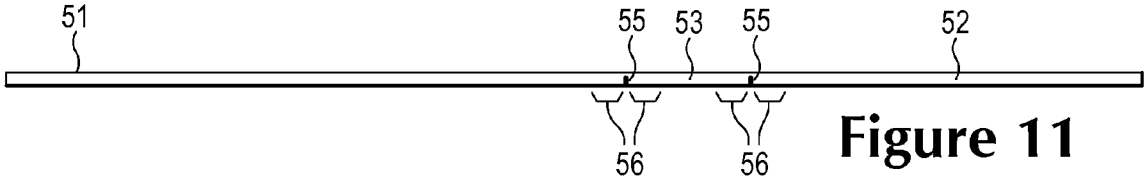
FIG. 11 is a lateral side elevational view of the upper plate.
Figure 12:
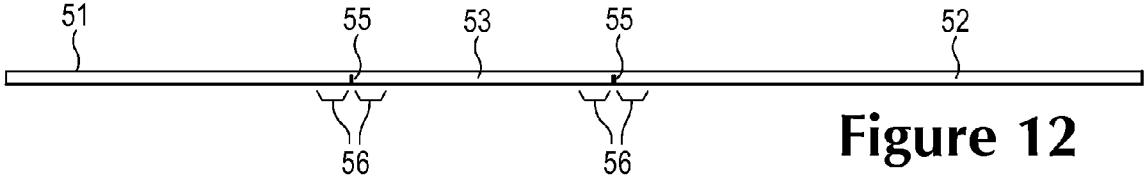
FIG. 12 is a medial side elevational view of the upper plate.
Figure 13:
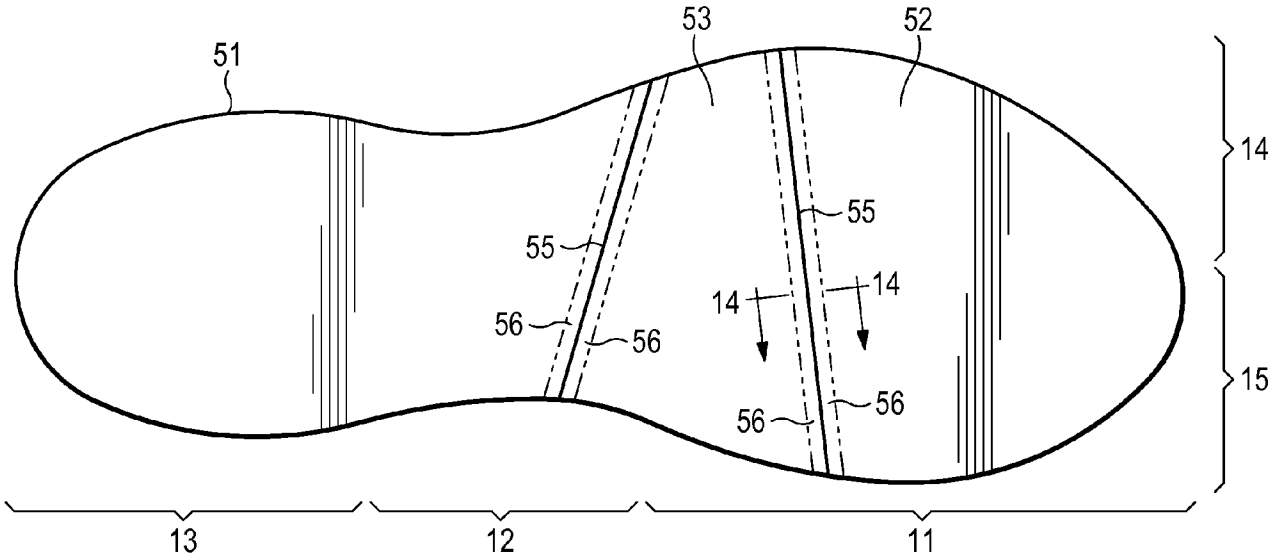
FIG. 13 is a bottom plan view of the upper plate.

An article of footwear 10 is depicted in FIGS. 1 and 2 as including an upper 20 and a sole structure 30. For reference purposes, footwear 10 may be divided into three general regions: a forefoot region 11, a midfoot region 12, and a heel region 13, as shown in FIGS. 1 and 2. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot. Heel region 13 generally includes portions of footwear 10 corresponding with rear portions of the foot, including the calcaneus bone. Lateral side 14 and medial side 15 extend through each of regions 11-13 and correspond with opposite sides of footwear 10. Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be discussed with respect to the individual elements thereof, such as upper 20 and sole structure 30, and to the foot itself.

Upper 20 is depicted as having a substantially conventional configuration incorporating a variety of material elements (e.g., textile, foam, leather, and synthetic leather) that are stitched or adhesively bonded together to form an interior void for securely and comfortably receiving a foot. The material elements may be selected and located with respect to upper 20 in order to selectively impart properties of durability, air-permeability, wear-resistance, flexibility, and comfort, for example. An ankle opening 21 in heel region 13 provides access to the interior void. In addition, upper 20 may include a lace 22 that is utilized in a conventional manner to modify the dimensions of the interior void, thereby securing the foot within the interior void and facilitating entry and removal of the foot from the interior void. Lace 22 may extend through apertures in upper 20, and a tongue portion of upper 20 may extend between the interior void and lace 22. Given that various aspects of the present application primarily relate to sole structure 30, upper 20 may exhibit the general configuration discussed above or the general configuration of practically any other conventional or nonconventional upper. Accordingly, the overall structure of upper 20 may vary significantly.

Sole structure 30 is secured to upper 20 and has a configuration that extends between upper 20 and the ground. In effect, therefore, sole structure 30 is located to extend between the foot and the ground. In addition to attenuating ground reaction forces (i.e., providing cushioning for the foot), sole structure 30 may provide traction, impart stability, and limit various foot motions, such as pronation.

The primary elements of sole structure 30 are a midsole 31 and an outsole 32. Midsole 31 may include a fluid-filled chamber 33. In addition to chamber 33, midsole 31 may incorporate one or more additional footwear elements that enhance the comfort, performance, or ground reaction force attenuation properties of footwear 10, including a polymer foam material, such as polyurethane or ethylvinylacetate, plates, moderators, lasting elements, or motion control members. Outsole 32, which may be absent in some configurations of footwear 10, is secured to a lower surface of midsole 31 and may be formed from a rubber material that provides a durable and wear-resistant surface for engaging the ground. In addition, outsole 32 may also be textured to enhance the traction (i.e., friction) properties between footwear 10 and the ground. Sole structure 30 may also incorporate an insole or sockliner that is located with in the void in upper 20 and adjacent (i.e., located nearby or close to, although not necessarily in contact with) a plantar surface or lower surface of the foot to enhance the comfort of footwear 10.

In some embodiments of sole structure 30, the location of fluid-filled chamber 33 may be restricted to one or more particular regions of footwear 10, such as forefoot region 11 or heel region 13. In some embodiments of sole structure 30, midsole 31 may include a fluid-filled chamber 33 but not include a polymer foam material. In such embodiments, an upper portion of fluid-filled chamber 33 may be positioned immediately adjacent to upper 20, and a lower portion of fluid-filled chamber 33 may be positioned immediately adjacent to outsole 32.

Chamber Configuration

Chamber 33 is depicted individually in FIGS. 3-8 as having a configuration that is suitable for footwear applications. When incorporated into footwear 10, chamber 33 has a shape that fits within a perimeter of midsole 31 and substantially extends from forefoot region 11 to heel region 13 and also from lateral side 14 to medial side 15, thereby corresponding with a general outline of the foot. Chamber 33 has an upper portion positioned adjacent to upper 20, a lower portion positioned adjacent to outsole 32, and a sidewall portion extending between the upper portion and the lower portion. Although chamber 33 is depicted as forming a sidewall of midsole 31, a polymer foam material of midsole 31 may form a portion of the sidewall in some configurations of footwear 10. When the foot is located within upper 20, chamber 33 extends under substantially all of the foot in order to attenuate ground reaction forces that are generated when sole structure 30 is compressed between the foot and the ground during various ambulatory activities, such as running and walking. In other configurations, chamber 33 may extend under only a portion of the foot.

The primary elements of chamber 33 are a barrier 40, an upper plate 51, and a supplemental lower plate 52. Barrier 40 forms an exterior of chamber 33 and (a) defines an interior void that receives a pressurized fluid, upper plate 51, and lower plate 52, and (b) provides a durable sealed barrier for retaining the pressurized fluid within chamber 33. The polymer material of barrier 40 includes an upper barrier portion 41, an opposite lower barrier portion 42, and a sidewall barrier portion 43 that extends around a periphery of chamber 33 and between barrier portions 41 and 42. Upper plate 51 and lower plate 52 are located within the interior void, upper plate 51 being secured to an interior surface of upper barrier portion 41, and lower plate 52 being secured to an interior surface of lower barrier portion 42 opposite upper plate 51. Upper plate 51 and lower plate 52 may be secured to barrier 40 by, for example, adhesive bonding or thermobonding. Upper plate 51 has indentations 55.

In manufacturing chamber 33, a pair of polymer sheets may be molded and bonded during a thermoforming process to define barrier portions 41-43. More particularly, the thermoforming process (a) imparts shape to one of the polymer sheets in order to form upper barrier portion 41 (b) imparts shape to the other of the polymer sheet in order to form lower barrier portion 42 and sidewall portion 43, and (c) forms a peripheral bond 44 that joins a periphery of each of the polymer sheets and extends around a top edge of sidewall barrier portion 43. The thermoforming process may also (a) position upper plate 51 and lower plate 52 within chamber 33 and (b) bond upper plate 51 and lower plate 52 to upper barrier portion 41 and lower barrier portion 42, respectively. Although substantially all of the thermoforming process may be performed with a mold, as described in greater detail below, each of the various parts of the process may be performed separately in forming chamber 33.

In some embodiments, such as embodiments in which chamber 33 may have a low profile, barrier portion 43 may have a less vertical configuration, or a more rounded or tapered configuration. Additionally, in some embodiments, peripheral bond 44 may extend instead around another length of sidewall barrier portion 43, such as a mid-section of sidewall barrier portion 43.

Following the thermoforming process, a fluid may be injected into the interior void and pressurized. Peripheral bond 44 joins the polymer sheets to form a seal that prevents the fluid from escaping. Accordingly, the pressurized fluid exerts an outward force upon chamber 33, which tends to separate barrier portions 41 and 42. In the absence of upper plate 51 and lower plate 52, barrier portions 41 and 42 may extend, distend, or otherwise bulge outward to impart a rounded or even cylindrical aspect to chamber 33. Plates 51 and 52, however, restrict outward expansion of barrier portions 41 and 42, which imparts a generally planar configuration to upper and lower surfaces of chamber 33. In some configurations, the combination of upper barrier portion 41 and upper plate 51, or the combination of lower barrier portion 42 and lower plate 52, restrict outward expansion of barrier portion 41 or 42 and impart a generally planar configuration to upper or lower surfaces of chamber 33. More particularly, upper plate 51, which is bonded to upper barrier portion 41, restricts the outward expansion (i.e., the upward expansion) of upper barrier portion 41. Similarly, lower plate 52, which is bonded to lower barrier portion 42, restricts the outward expansion (i.e., the downward expansion) of lower barrier portion 42. As discussed in greater detail below, however, indentations 55 in a lower side of upper plate 51 may allow upper plate 51 to deflect inward and toward a central area of the cavity within chamber 33. Moreover, indentations 55 have a structure that resists the outward expansion or distension of chamber 33, while accommodating inward flexing or compression. An advantage of indentations 55 is, therefore, that chamber 33 may deflect inward to enhance the attenuation of ground reaction forces (i.e., impart cushioning) of footwear 10, while retaining an intended shape of chamber 33.

Chamber 33 is shaped to provide a structure that is suitable for footwear applications. As noted above, chamber 33 has a shape that fits within a perimeter of midsole 31 and extends under substantially all of the foot, thereby corresponding with a general outline of the foot. With reference to FIGS. 6D-8, chamber 33 exhibits a tapered configuration between heel region 13 and forefoot region 11. That is, the portion of chamber 33 in heel region 13 exhibits a greater overall thickness than the portion of chamber 33 in forefoot region 11. When incorporated into footwear 10, the tapering of chamber 33 ensures that the heel of the foot is slightly raised in relation to the forefoot.

The fluid within chamber 33 may be pressurized between zero and three hundred fifty kilopascals (i.e., approximately fifty-one pounds per square inch) or more. In addition to air and nitrogen, the fluid may include any of the gasses disclosed in U.S. Pat. No. 4,340,626 to Rudy. In some configurations, chamber 33 may incorporate a valve or other structure that permits the individual to adjust the pressure of the fluid.

A wide range of polymer materials may be utilized for chamber 33. In selecting materials for barrier 40, engineering properties of the material (e.g., tensile strength, stretch properties, fatigue characteristics, dynamic modulus, and loss tangent) as well as the ability of the material to prevent the diffusion of the fluid contained by barrier 40 may be considered. When formed of thermoplastic urethane, for example, barrier 40 may have a thickness of approximately 1.0 millimeter, but the thickness may range from 0.25 to 2.0 millimeters or more, for example. In addition to thermoplastic urethane, examples of polymer materials that may be suitable for chamber 33 include polyurethane, polyester, polyester polyurethane, and polyether polyurethane. Barrier 40 may also be formed from a material that includes alternating layers of thermoplastic polyurethane and ethylene-vinyl alcohol copolymer, as disclosed in U.S. Pat. Nos. 5,713,141 and 5,952,065 to Mitchell, et al. A variation upon this material may also be utilized, wherein a center layer is formed of ethylene-vinyl alcohol copolymer, layers adjacent to the center layer are formed of thermoplastic polyurethane, and outer layers are formed of a regrind material of thermoplastic polyurethane and ethylene-vinyl alcohol copolymer. Another suitable material for barrier 40 is a flexible microlayer membrane that includes alternating layers of a gas barrier material and an elastomeric material, as disclosed in U.S. Pat. Nos. 6,082,025 and 6,127,026 to Bonk, et al. Additional suitable materials are disclosed in U.S. Pat. Nos. 4,183,156 and 4,219,945 to Rudy. Further suitable materials include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340; 6,203,868; and 6,321,465 to Bonk, et al.

In order to facilitate bonding between barrier 40 and plates 51 and 52, plates 51 and 52 may be formed of, or formed to include, polymer bonding materials (e.g., thermoplastic polymer materials, adhesives, heat-activated bonding agents). When heated, the polymer bonding materials soften, melt, or otherwise begin to change state so that contact with barrier portions 41 and 42 induces material from each of barrier 40 and the polymer bonding materials to intermingle or otherwise join with each other. Upon cooling, therefore, the polymer bonding materials are permanently joined with barrier 40, thereby joining plates 51 and 52 with barrier 40. In some configurations, an adhesive may be utilized to secure barrier 40 to plates 51 and 52.

In some embodiments, either upper barrier portion 41 may be co-molded with upper plate 51, or lower barrier portion 42 may be co-molded with lower plate 52. In such embodiments, plate 51 or 52 may not be physically separate from barrier portion 41 or 42, but may instead be physically formed together with or at the same time as barrier portion 41 or 42. In other words, upper plate 51 may be part of, or may be integrally formed with, upper barrier portion 41. Similarly, lower plate 52 may be part of, or may be integrally formed with, lower barrier portion 42.

Upper Plate Configuration

An initial configuration of upper plate 51, depicted individually in FIGS. 9-14, includes indentations 55. Upper plate 51 is a generally planar structure being substantially similar in shape to, but slightly smaller than, chamber 33. As a result, upper plate 51, like chamber 33, has a shape corresponding with a general outline of the foot. Indentations 55 are substantially linear and extend across upper plate 51, between lateral side 14 of upper plate 51 and medial side 15 of upper plate 51. Indentations 55 are located in forefoot region 11 and midfoot region 12, on both the forefoot side and the heel side of portions of upper plate 51 corresponding with the joints connecting the metatarsals of the foot with the phalanges of the foot. Indentations 55 are formed on the lower surface or inner side (i.e., the inward-facing side) of upper plate 51.

In the initial configuration, edge areas 56 are substantially linear and are adjacent to indentations 55 on the lower surface or inner side of upper plate 51. Edge areas are portions of upper plate 51, including portions of surfaces of upper plate 51, that are adjacent to and on opposite sides of indentations 55.

Indentations 55 may be flexion areas defined in a surface of upper plate 51. Upper plate 51 may be significantly more flexible or bendable at flexion areas than away from flexion areas. Additionally, edge areas 56 may be flexion stops defined in a surface of upper plate 51 and located adjacent to indentations 55. A flexing or bending in one direction of upper plate 51 at a flexion area may be restricted, blocked, or otherwise hindered by a corresponding flexion stop. For example, in the initial configuration, a flexing or bending in one direction of upper plate 51 at indentations 55 may be restricted, blocked, or otherwise hindered by edge areas 56, whereas a flexing or bending in the opposite direction of upper plate 51 at indentations 55 may be unobstructed.

Indentations 55 may be living hinges. Upper plate 51, or portions of upper plate 51 including indentations 55, may incorporate a polymer, including thermoplastic polymers such as polyethylene and polypropylene. Upper plate 51, measured at a living hinge in upper plate 51, may be thin relative to portions of upper plate 51 apart from a living hinge in upper plate 51. Upper plate 51 may be compressed at a living hinge, or made thinner than as molded, through a pressuring or coining process. Upper plate 51 may be capable of flexing or bending about a living hinge a great number of times before losing structural integrity. For example, indentations 55 formed to be living hinges may be capable of bending throughout the expected life of footwear 10 without failure or damage.

Indentations 55 may be defined in a surface of upper plate 51 to extend into a portion of upper plate 51. That is, indentations 55 may be cuts, grooves, scores, or other depressions, molded or otherwise formed in upper plate 51. Edge areas may be defined in a surface of upper plate 51 and may be located immediately adjacent to and on opposite sides of indentations 55. That is, edge areas 56 may be areas of upper plate 51 adjacent to and on opposite sides of cuts, grooves, scores, or other depressions, molded or otherwise formed in upper plate 51.

Figure 14:
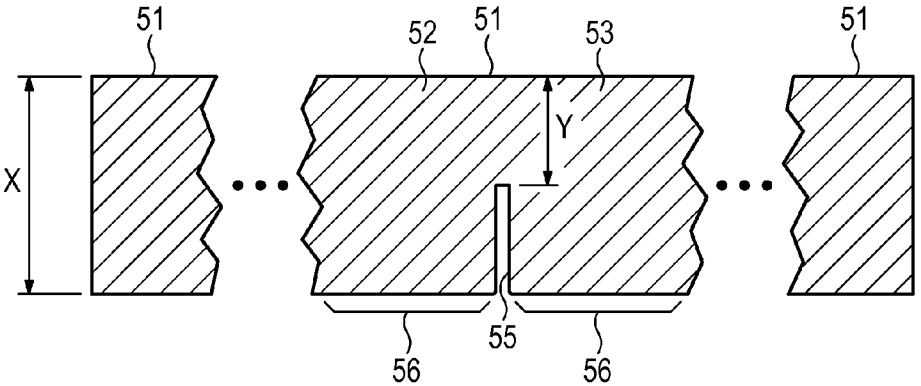
FIG. 14 is a cross-sectional view of the upper plate, as defined by section line 14-14 in FIG. 13.

A thickness of upper plate 51 in an area spaced from indentations 55 may be greater than a thickness of upper plate 51 within indentations 55. For example, in the initial configuration, a first thickness of upper plate 51 at an area spaced away from indentations 55 is at least twice as great as a second thickness of upper plate 51 measured within indentations 55. Referring specifically to FIG. 14, for example, a first thickness X is spaced from indentation 55 and is greater than a second thickness Y within indentation 55. Additionally, in the initial configuration, the thickness of upper plate 51 is substantially uniform outside of indentations 55, even at areas adjacent to indentations 55. Accordingly, the thickness of upper plate 51 measured at edge areas 56 is also at least two times the thickness of upper plate 51 measured within indentations 55.

Indentations 55 may be cuts, grooves, scores, or other depressions whose width is narrow relative to other dimensions associated with indentations 55 and edge areas 56. For example, in the initial configuration, a width of indentations 55 is less than such dimensions as the thickness of upper plate 51 in edge areas 56, the thickness of upper plate 51 measured at indentations 55, and the difference between those two thicknesses.

Indentations 55 may be flexion lines. Upper plate 51 may flex or bend along a flexion line under application of a flexing force in preference to flexing along another portion of upper plate 51 away from the flexion line. This preferential flexing may be due to structural differences between the flexion line of upper plate 51 and other portions of upper plate 51, such as differences of size or dimension, or differences of material composition, or differences of treatment or processing of the constituent material or materials. For example, upper plate 51 may have a lesser thickness along a flexion line than another portion of upper plate 51 away from the flexion line. Under an applied flexing force, one area of upper plate 51 may rotate about the flexion line relative to another area of upper plate 51 located on an opposite side of the flexion line. For example, in the initial configuration, a first area 52 of upper plate 51 and a second area 53 of upper plate 52, located on opposite sides of an indentation 55, may rotate about the indentation 55 under application of a flexing force between first area 52 and second area 53.

Figure 24A:
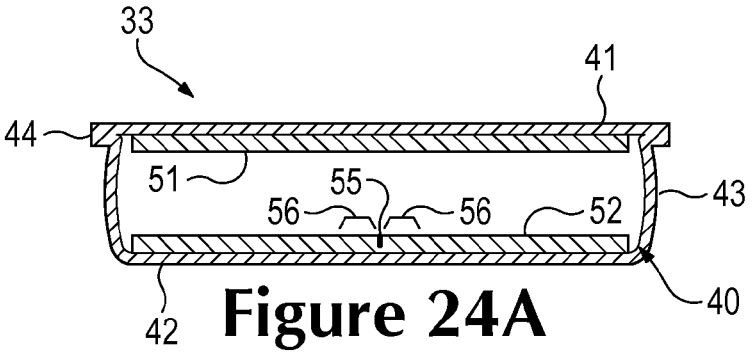
FIGS. 24A-24F are cross sectional views corresponding with FIG. 6B and depicting further configurations of the chamber.
Figure 24B:
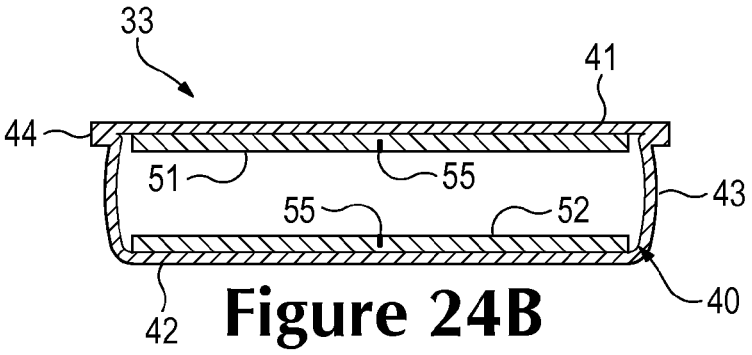
Figure 24C:
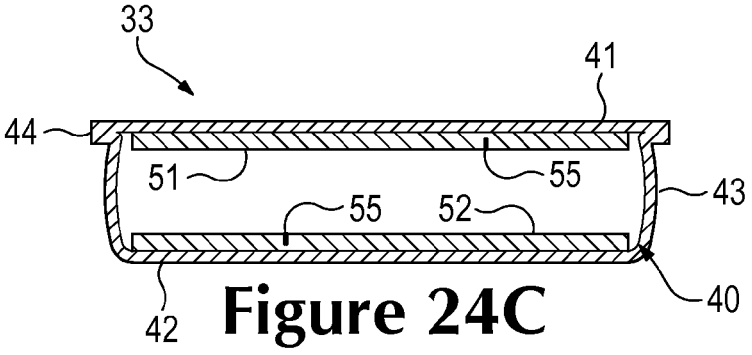
Figure 24D:
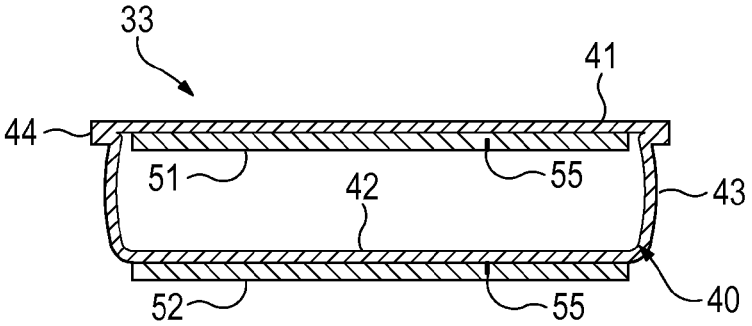
Figure 24E:
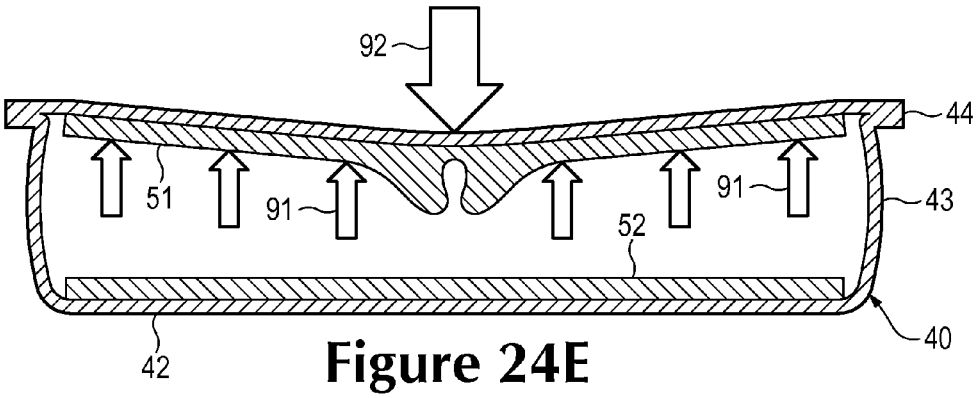
Figure 24F:
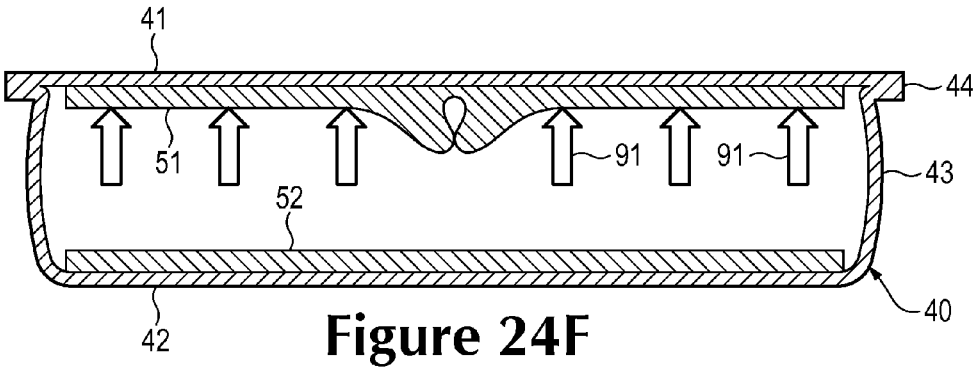

A portion of upper plate 51 immediately adjacent to indentations 55 may obstruct, hinder, or restrict the rotation of one area of upper plate 51 about a flexion line relative to another area of upper plate 51 located on an opposite side of the flexion line. Rotation may be restricted under application of a flexing force in one direction, but not restricted under application of a flexing force in another direction, as depicted in FIGS. 24E and 24F. For example, in the initial configuration, edge areas 56 restrict the rotation of first area 52 relative to second area 53 about indentation 55 in one direction, but do not restrict the rotation of first area 52 relative to second area 53 about indentation 55 in another direction. More specifically, edge areas 56 restrict rotation about indentations 55 under an upward flexing, but do not restrict rotation about indentations 55 under a downward flexing force.

The material of upper plate 51 or lower plate 52 may have a different modulus of elasticity (i.e., stiffness) than the material of barrier portions 41 and 42. In some configurations, for example, barrier portions 41 and 42 may be formed of a first polymer material having a first stiffness, and plates 51 and 52 may be formed of a second polymer material having a second stiffness, and the first stiffness may be less than the second stiffness. That is, the material of barrier portions 41 and 412 may be less stiff than the material of plates 51 and 52.

Manufacturing Process

Figure 15:
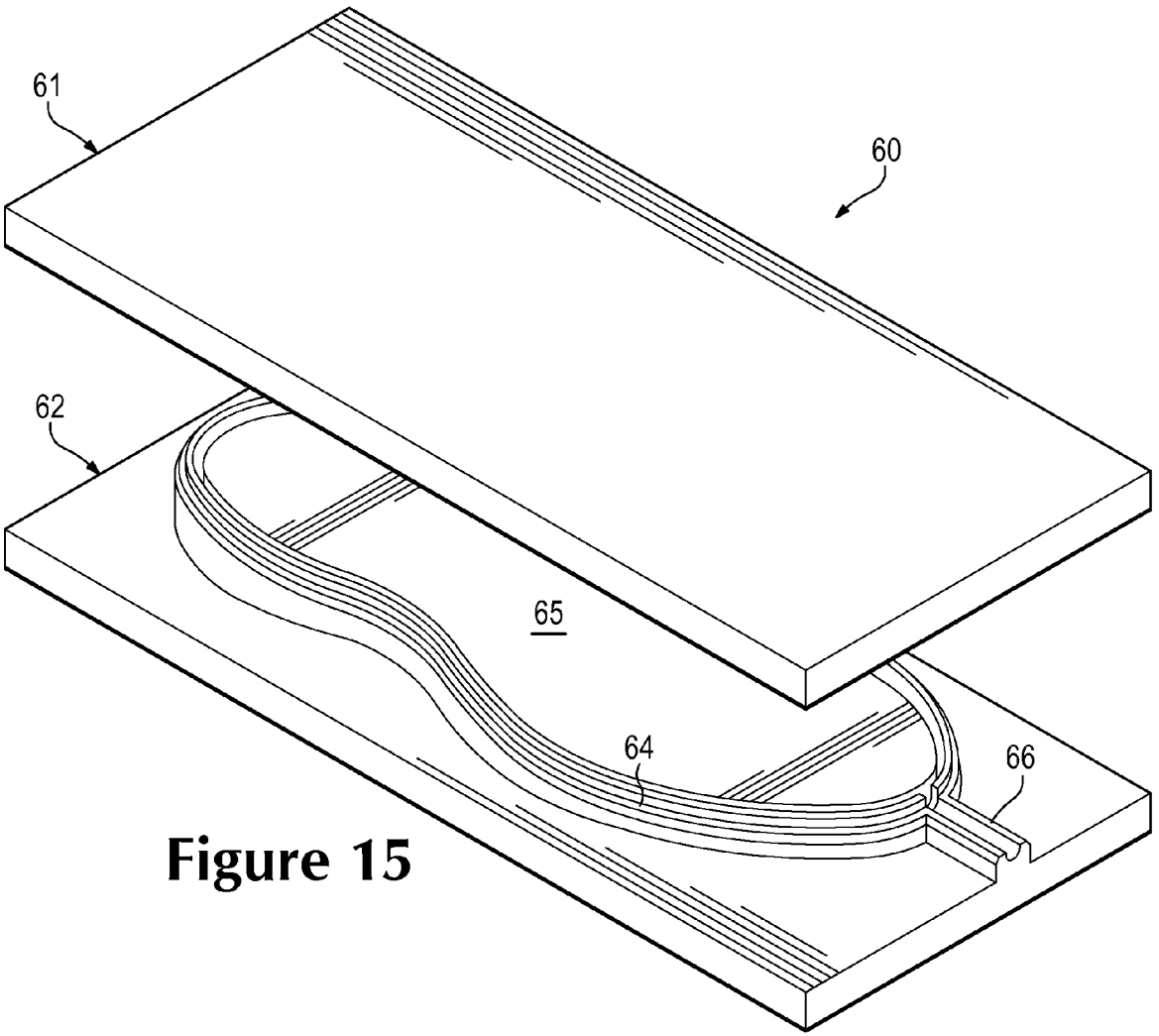
FIG. 15 is a perspective view of a mold for forming the chamber.

Although a variety of manufacturing processes may be utilized to form chamber 33, an example of a suitable thermoforming process will now be discussed. With reference to FIG. 15, a mold 60 that may be utilized in the thermoforming process is depicted as including an upper mold portion 61 and a lower mold portion 62. Mold 60 is utilized to form chamber 33 from a pair of polymer sheets that are molded and bonded to define surfaces 41-43, and the thermoforming process secures upper plate 51 and lower plate 52 to barrier 40. More particularly, mold 60 (a) imparts shape to one of the polymer sheets in order to form upper barrier portion 41 (b) imparts shape to the other of the polymer sheets in order to form lower barrier portion 42 and sidewall barrier portion 43, and (c) forms a peripheral bond 44 that joins a periphery of each of the polymer sheets and extends around a top edge of sidewall barrier portion 43. Mold 60 also respectively bonds upper plate 51 and lower plate 52 to barrier portions 41 and 42.

A securing structure may establish a positional relationship between upper plate 51 and lower plate 52 during various portions of the manufacturing process. In some configurations, one or more upper alignment members 57 of upper plate 51 may be secured to one or more corresponding lower alignment members 58 of lower plate 52. In some configurations, upper alignment members 57 may be indentations in upper plate 51, and lower alignment members 58 may be protrusions of lower plate 52. In other configurations, upper alignment members 57 may protrude from upper plate 51, and lower alignment members 48 may be indentations within lower plate 52. Alternatively, each of alignment members 57 and 58 may include any mix or hybrid arrangement of indentations and protrusions capable of fitting against the corresponding alignment member. In other configurations, upper plate 51 and lower plate 52 may be connected by a temporary securing structure, in which one or more upper alignment members 57 of upper plate 51 are bonded to or are otherwise formed to be part of the same structure as one or more lower alignment members 58 of lower plate 52. The securing of upper alignment members 57 against lower alignment members 58 may operate to establish a positional relationship between upper plate 51 and lower plate 52. The securing may also operate to maintain that positional relationship for various subsequent portions of the manufacturing process.

In manufacturing chamber 33, one or more of an upper polymer layer 71, a lower polymer layer 72, and plates 51 and 52 are heated to a temperature that facilitates bonding between the components. As discussed in greater detail below, polymer layers 71 and 72 respectively become barrier portions 41 and 42 during the manufacturing of chamber 33. Depending upon the specific materials utilized for plates 51 and 52 and polymer layers 71 and 72, which form barrier 40, suitable temperatures may range from 120 to 200 degrees Celsius (248 to 392 degrees Fahrenheit) or more. As an example, a material having alternating layers of thermoplastic polyurethane and ethylene-vinyl alcohol copolymer may be heated to a temperature in a range of 149 to 188 degrees Celsius (300 and 370 degrees Fahrenheit) to facilitate bonding. Various radiant heaters or other devices may be utilized to heat the components of chamber 33. In some manufacturing processes, mold 60 may be heated such that contact between mold 60 and the components of chamber 33 raises the temperature of the components to a level that facilitates bonding.

Figure 16A:
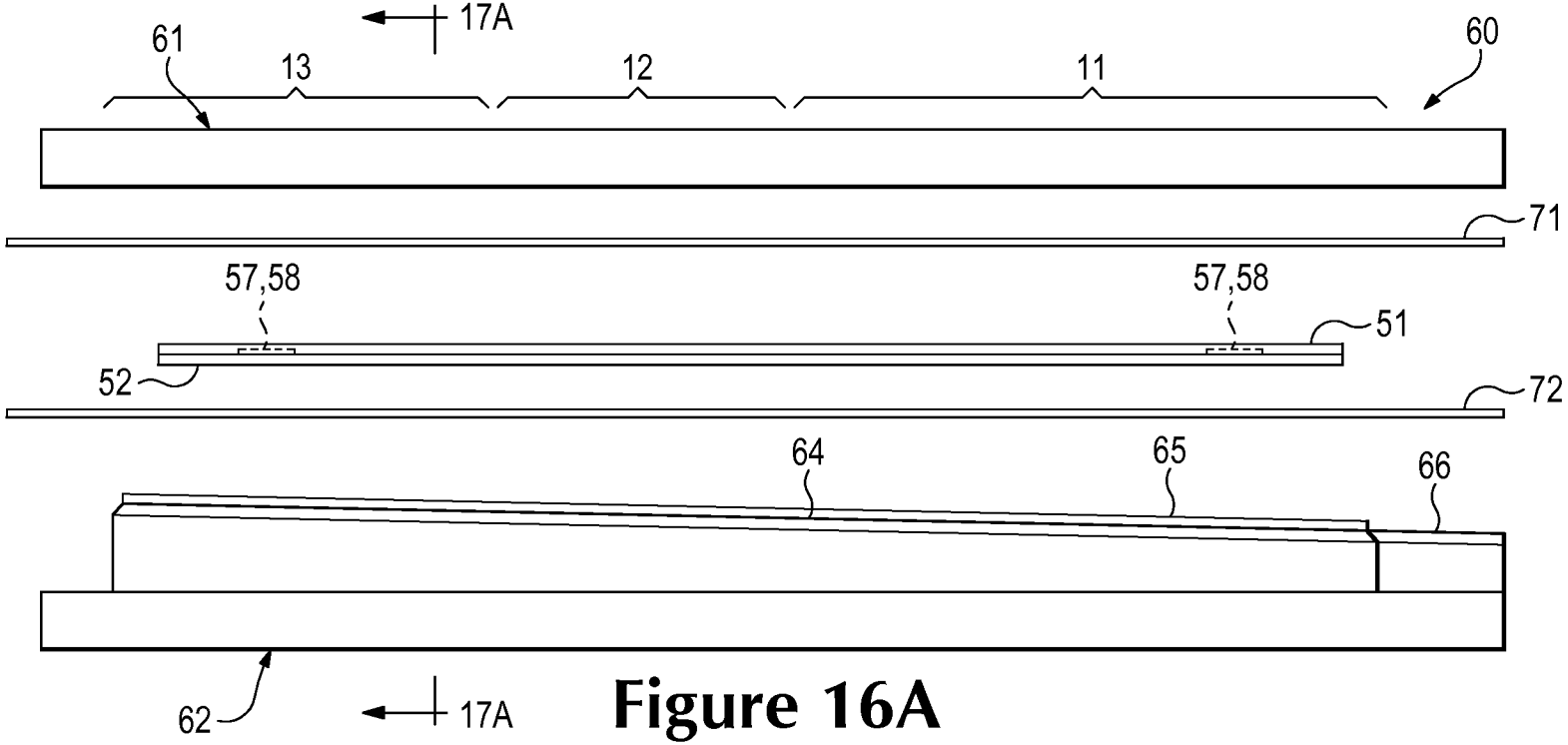
FIGS. 16A-16D are side elevational views depicting steps in a process of manufacturing the chamber.
Figure 16B:
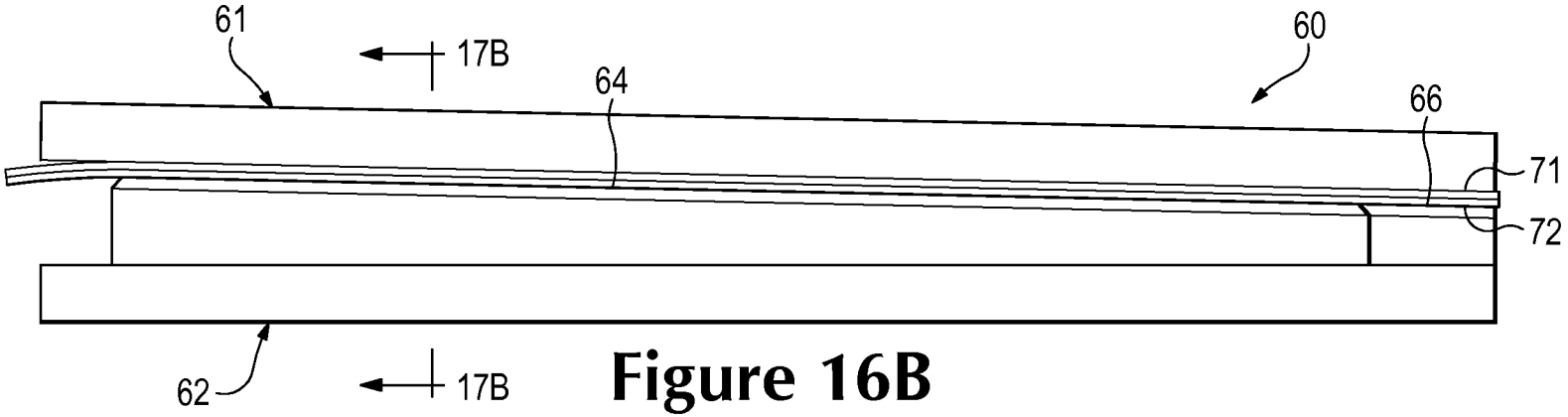
Figure 17A:
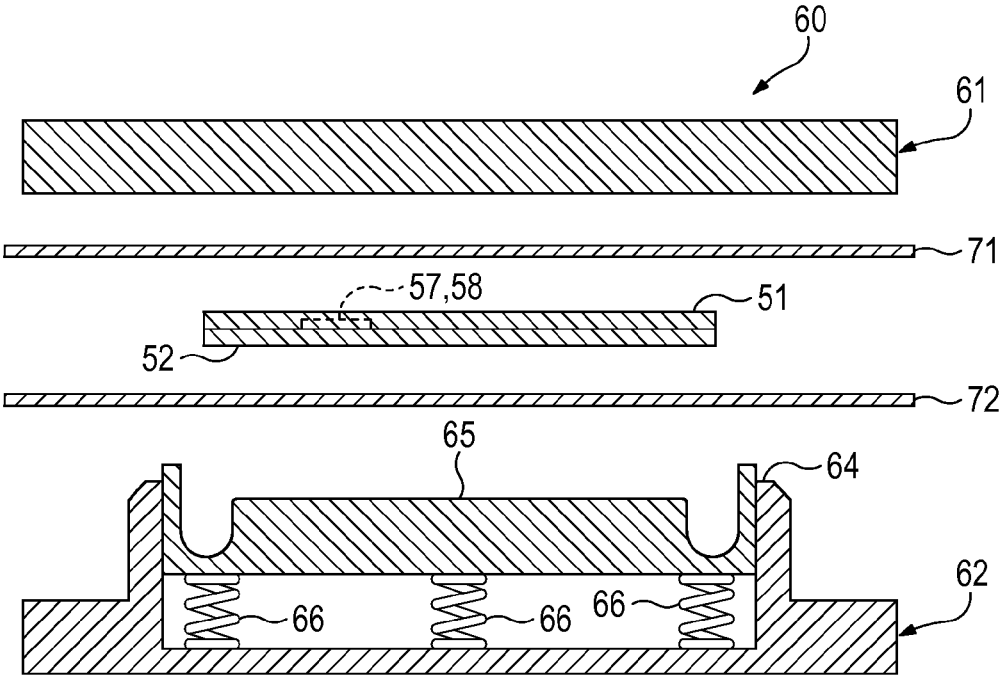
FIGS. 17A-17D are cross-sectional views depicting steps in the process of manufacturing the chamber, as defined by section lines 17A-17A through 17D-17D in FIGS. 16A-16D.
Figure 17B:
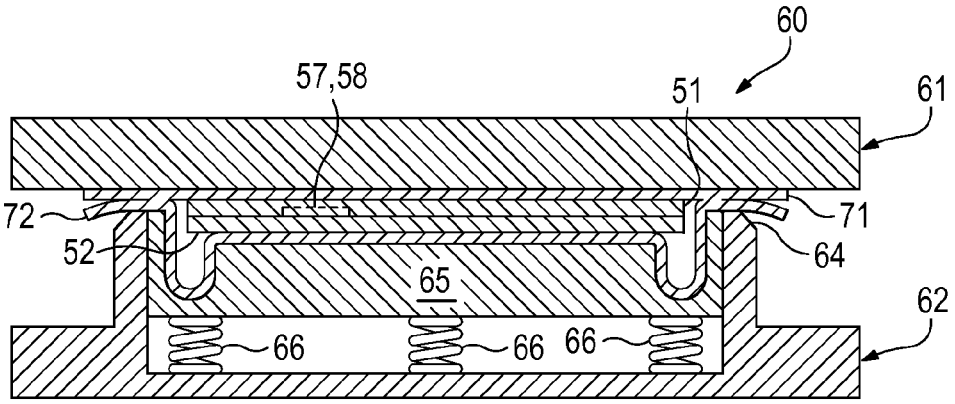

Following heating, the components of chamber 33 (i.e., polymer layers 71 and 72 and plates 51 and 52) are located between mold portions 61 and 62, as depicted in FIGS. 16A and 17A. Once positioned, mold portions 61 and 62 translate toward each other and begin to close upon the components such that (a) upper mold portion 61 contacts upper polymer layer 71, (b) a ridge 64 of lower mold portion 62 contacts lower polymer layer 72, and (c) polymer layers 71 and 72 begin bending to extend into a cavity within mold 60, as depicted in FIGS. 16B and 17B. Accordingly, the components are located relative to mold 60 and initial shaping and positioning has occurred.

In alternate embodiments, upper plate 51, lower plate 52, or both may be positioned adjacent to an exterior surface of chamber 33. In some alternate embodiments, upper plate 51 may be placed between mold portion 61 and polymer layer 71. For example, upper plate 51 may be placed adjacent to a surface of mold portion 61, and may be positioned with respect to mold portion 61 for the process of forming chamber 33. In other alternate embodiments, lower plate 52 may be placed between mold portion 62 and polymer layer 72. For example, lower plate 52 may be placed within mold portion 62, and may be positioned with respect to mold portion 62 for the process of forming chamber 33. In such alternate embodiments, polymer layers 71 and 72 may then be drawn into the contours of mold 60 such that at least one of polymer layers 71 and 72 contacts and is bonded to at least one of plates 51 and 52. A variety of techniques may be utilized to secure plates 51 and 52 to mold portions 61 and 62, including a vacuum system, various seals, or non-permanent adhesive elements, for example. In addition, plates 51 and 52 may include various tabs that define apertures, and mold portions 61 and 62 may include protrusions that engage the apertures to secure plates 51 and 52 with respect to mold portions 61 and 62.

Subsequently, air may be partially evacuated from the area around polymer layers 71 and 72 through various vacuum ports in mold portions 61 and 62. The purpose of evacuating the air is to draw polymer layers 71 and 72 into contact with the various contours of mold 60. This ensures that polymer layers 71 and 72 are properly shaped in accordance with the contours of mold 60. Note that polymer layers 71 and 72 may stretch in order to extend around plates 51 and 52 and into mold 60. In comparison with the thickness of barrier 40 in chamber 33, polymer layers 71 and 72 may exhibit greater thickness. This difference between the original thicknesses of polymer layers 71 and 72 and the resulting thickness of barrier 40 may occur as a result of the stretching that occurs during this stage of the thermoforming process. Moreover, given that lower polymer layer 72 may stretch to a greater degree than upper polymer layer 71 during the manufacturing process, lower polymer layer 72 may have a greater initial thickness than upper polymer layer 71 in order to equalize the resulting thicknesses of barrier portions 41 and 42 in the finished chamber 33.

In order to provide a second means for drawing polymer layers 71 and 72 into contact with the various contours of mold 60, the area between polymer layers 71 and 72 may be pressurized. During a preparatory stage of this method, an injection needle may be located between polymer layers 71 and 72, and the injection needle may be located such that upper mold portion 61 and ridge 64 envelop the injection needle when mold 60 closes. A gas may then be ejected from the injection needle such that polymer layers 71 and 72 engage upper mold portion 61 and ridge 64, thereby forming an inflation conduit 73 (see FIG. 16C) between polymer layers 71 and 72. The gas may then pass through inflation conduit 73, thereby entering and pressurizing the area between polymer layers 71 and 72. In combination with the vacuum, the internal pressure ensures that polymer layers 71 and 72 contact the various surfaces of mold 60.

As mold 60 closes further, ridge 64 bonds upper polymer layer 71 to lower polymer layer 72, as depicted in FIGS. 16B and 17B, thereby forming peripheral bond 44. In addition, a movable insert 65 that is supported by various springs 66 (as depicted in FIG. 17A) may depress to place a specific degree of pressure upon the components, thereby bonding polymer layers 71 and 72 to upper plate 51 and lower plate 52. Depressions or channels may be formed near the outside perimeter of movable insert 65 to impart a configuration to sidewall barrier portion 43. As discussed above, plates 51 and 52 may be formed to include polymer bonding materials in order to facilitate bonding between plates 51 and 52 and barrier 40. The pressure exerted upon the components by insert 65 ensures that the polymer bonding materials form a bond with polymer layers 71 and 72. Furthermore, portions of ridge 64 that extend away from plates 51 and 52 form a bond between other areas of polymer layers 71 and 72 to form inflation conduit 73.

Figure 16C:
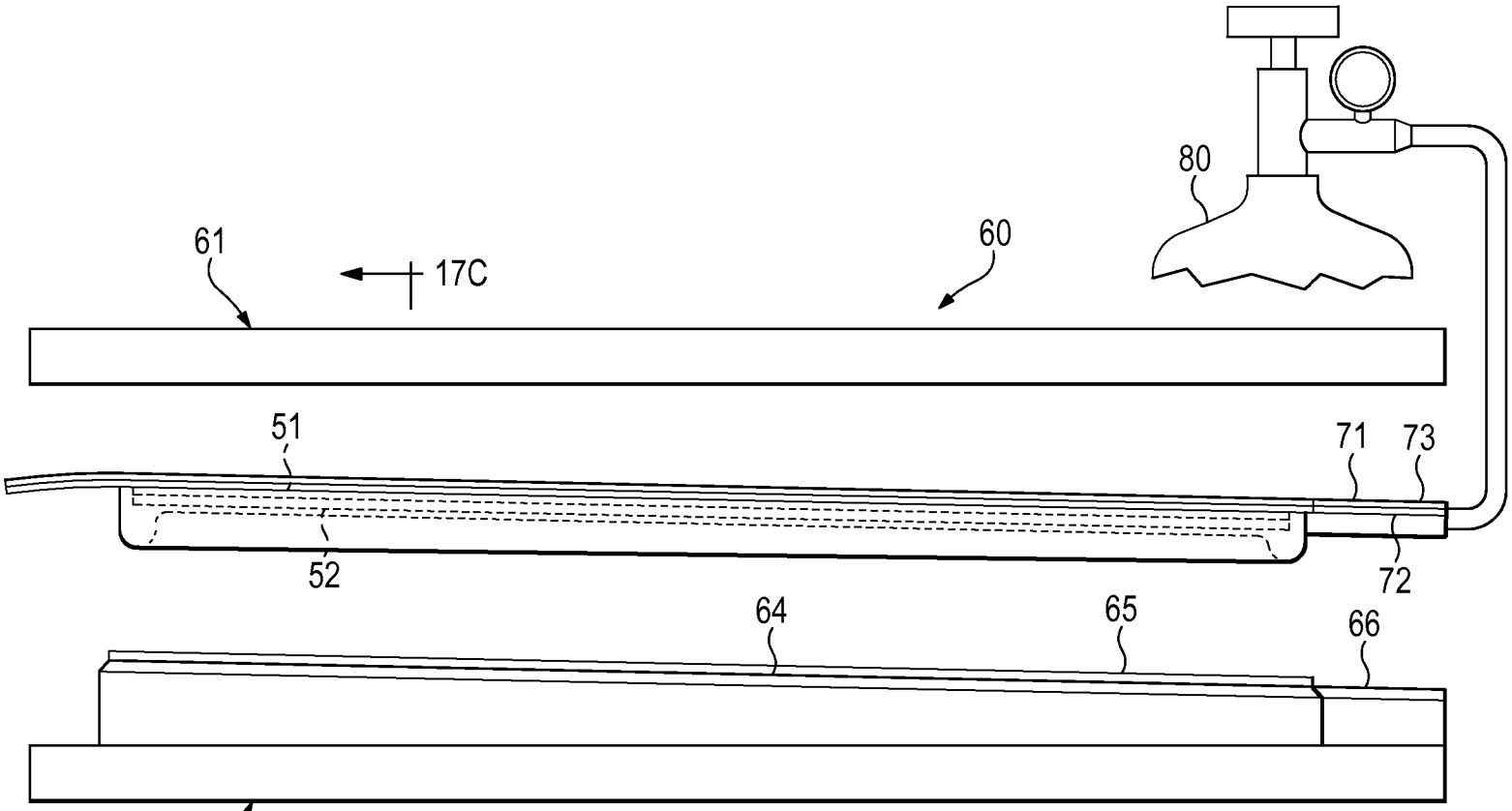
Figure 17C:
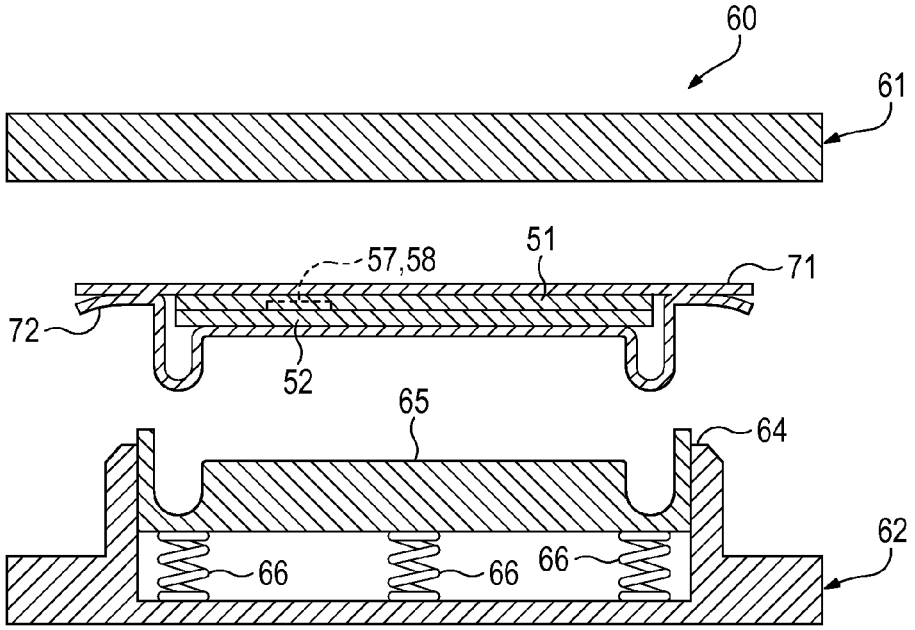

When bonding is complete, mold 60 is opened and chamber 33 and polymer layers 71 and 72 are removed and permitted to cool, as depicted in FIGS. 16C and 17C. A fluid may then be injected from pressure source 80 into chamber 33 through inflation conduit 73. As the fluid is injected from pressure source 80, the securing structure comprising upper alignment member 57 and lower alignment member 58 may be separated or broken, and upper plate 51 and lower plate 52 may accordingly separate from each other. By controlling (a) the configuration of mold 60, (b) an initial positional relationship between upper plate 51 and lower plate 52, and (c) the bonding of plates 51 and 52 to polymer layers 71 and 72, the establishment of a positional relationship between upper plate 51 and lower plate 52 within chamber 33 subsequent to pressurization may be facilitated. Subsequently, a sealing process may be utilized to seal inflation conduit 73 adjacent to chamber 33 after pressurization.

Figure 16D:
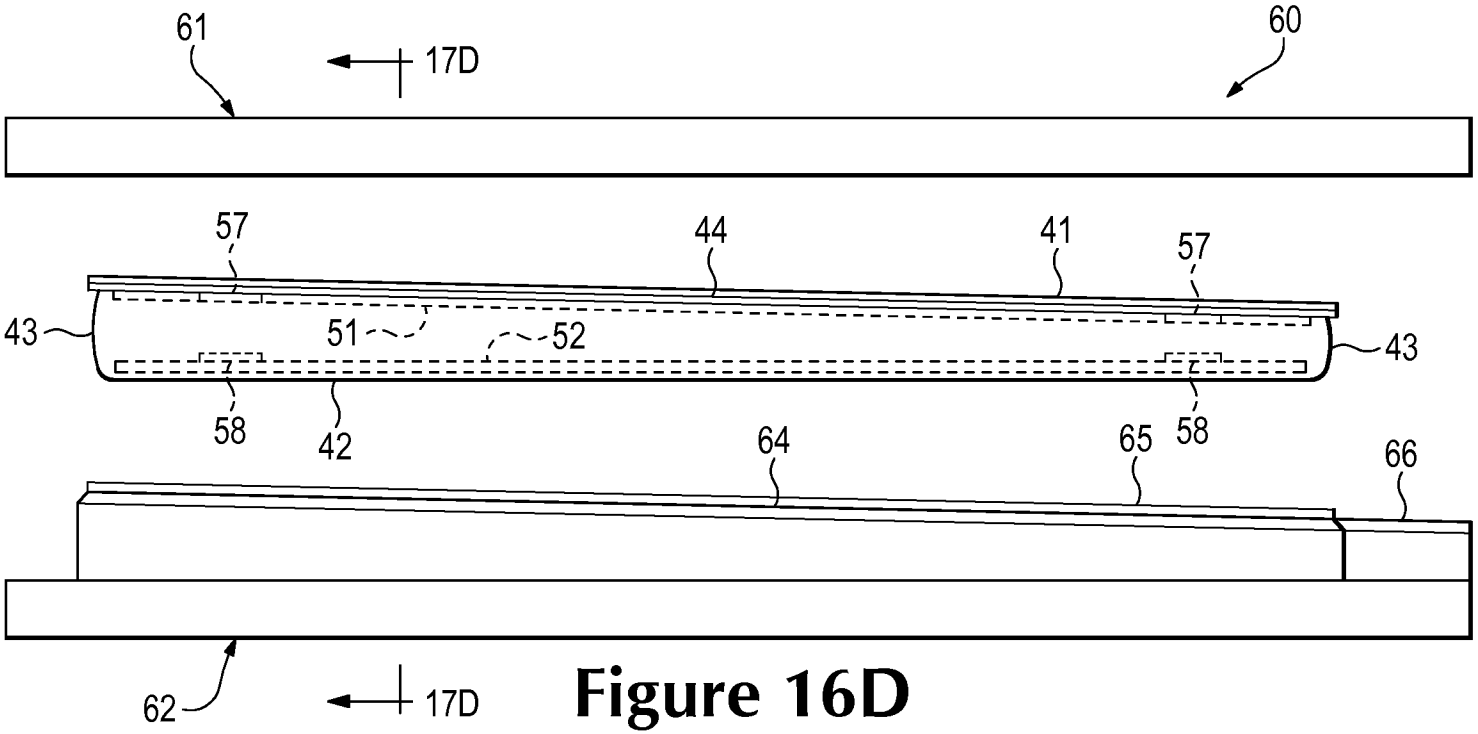
Figure 17D:
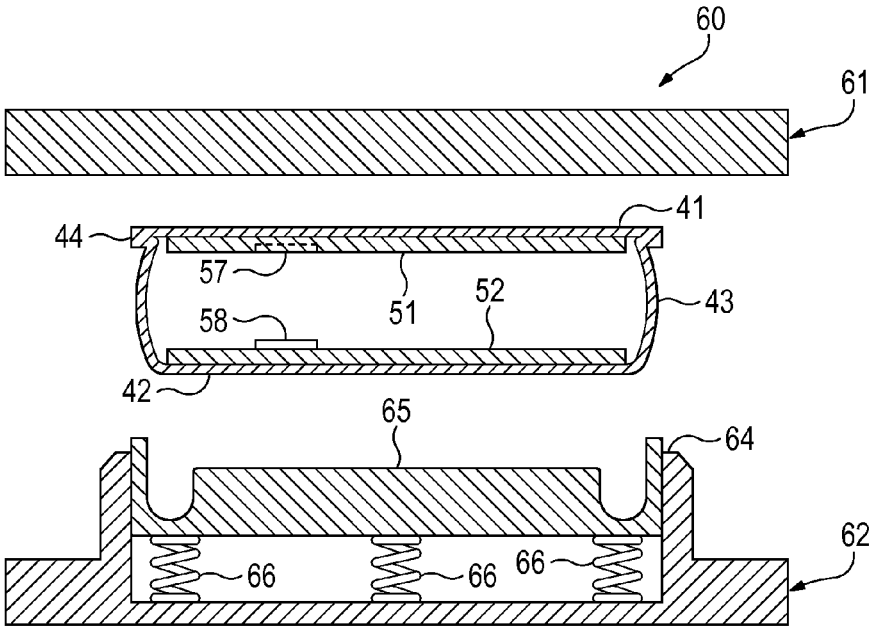

When pressurization is complete, excess portions of polymer layers 71 and 72 are then removed, thereby completing the manufacture of chamber 33, as depicted in FIGS. 16D and 17D. As an alternative, the order of inflation and removal of excess material may be reversed. As a final step in the process, chamber 33 may be tested and then incorporated into midsole 31 of footwear 10.

Based upon the above discussion, mold 60 is utilized to (a) impart shape to upper polymer layer 71 in order to form upper barrier portion 41 (b) impart shape to lower polymer layer 72 in order to form lower barrier portion 42 and sidewall barrier portion 43, and (c) form peripheral bond 44 between polymer layers 71 and 72. Mold 60 also (a) bonds upper plate 51 to the portion of upper polymer layer 71 that forms upper barrier portion 41 and (b) bonds lower plate 52 to the portion of lower polymer layer 72 that forms lower barrier portion 42.

The surfaces of mold 60 that shape barrier portions 41 and 42 are depicted as being substantially parallel and planar. Chamber 33, however, exhibits a tapered configuration between heel region 13 and forefoot region 11. When chamber 33 is pressurized, tapering may arise due to the configuration of upper mold 61 and lower mold 62. For example, the cavity of mold 60 used to form chamber 33 may have one height in heel region 13, and another, lesser height in forefoot region 11.

In some manufacturing processes, chamber 33, as well as upper plate 51, lower plate 52, or both, may incorporate features such as contours, indentations, protrusions, or shaping. For example, chamber 33 or upper plate 51 may incorporate a depression in heel region 13. Accordingly, the configuration of mold 60 may incorporate corresponding contours, indentations, protrusions, or shaping to facilitate the formation of such features in chamber 33 and to impart such features to chamber 33.

In alternate manufacturing processes, a ridge in upper mold portion 61 corresponding with ridge 64 in lower mold portion 62 may allow upper mold portion 61 to impart a configuration to an upper part of sidewall barrier portion 43. In such manufacturing processes, peripheral bond 44 may instead extend around a mid-section of sidewall barrier portion 43. Accordingly, by controlling the ridge in upper mold portion 61 and ridge 64 in lower mold portion 62, peripheral bond may be located on the same plane as either upper barrier portion 41 or lower barrier portion 42, or at any mid-section in between.

Upper plate 51 and lower plate 52 are depicted in FIGS. 16A-16D and in FIGS. 17A-17D as having essentially no curvature (i.e., as having a substantially flat shape) throughout the manufacturing process. However, the manufacturing process may change a curvature of or impart a curvature to upper plate 51, lower plate 52, or both. For example, upper plate 51 or lower plate 52 may have essentially no curvature before chamber 33 is pressurized, whereas an outward curvature may be imparted to upper plate 51 or lower plate 52, or portions thereof, after chamber 33 is pressurized. Accordingly, upper plate 51, lower plate 52, or both may be formed to have an inward curvature before chamber 33 is pressurized, such that plates 51 and 52 have essentially no curvature after chamber 33 is pressurized, as disclosed in U.S. Pat. No. 7,533,477 to Goodwin et al.

Further Configurations

Figure 18A:
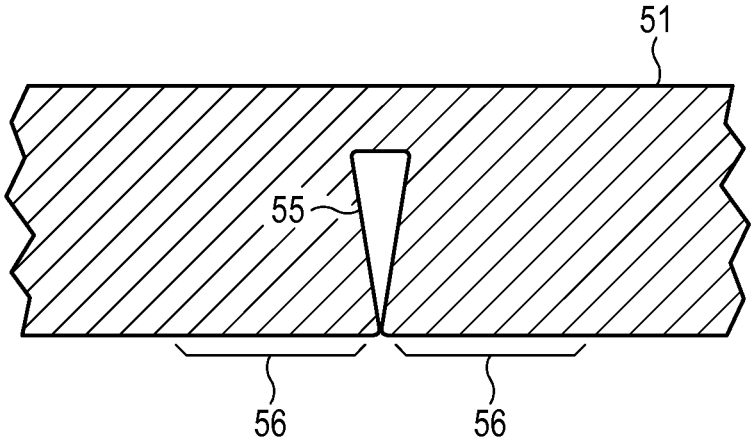
FIGS. 18A-18G are cross-sectional views corresponding with FIG. 14 and depicting further configurations of the upper plate.
Figure 18B:
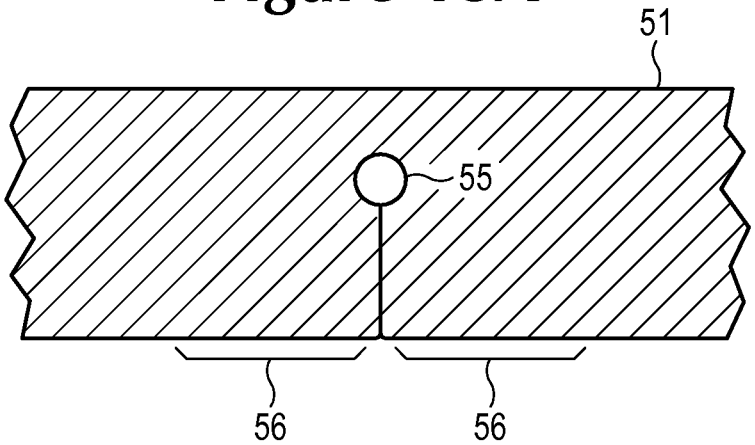
Figure 18C:
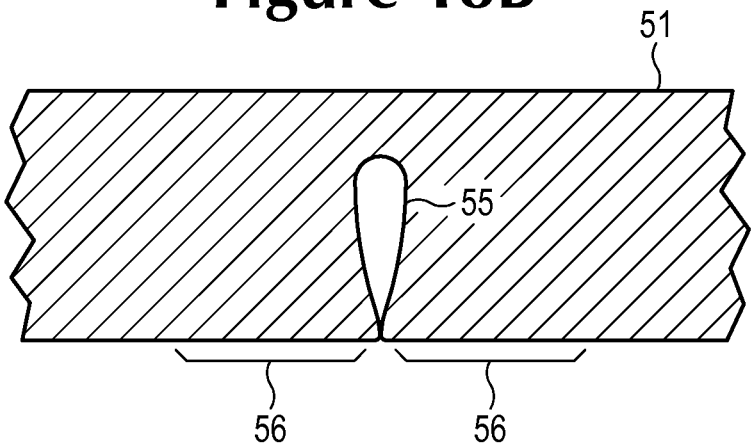

Indentations 55 may exhibit further cross-sectional configurations. In the initial configuration of upper plate 51, as depicted in FIG. 14, indentations 55 have a generally rectangular cross-sectional configuration. That is, indentations 55 have sides at substantially right angles with each other, and a depth of indentations 55 is greater than a width of indentations 55. In contrast, for example, with reference to FIG. 18A, indentation 55 in cross-section has a generally triangular shape, with two sides of the triangular cross-section imparting a depth greater than a width imparted by a third, inner side of the triangular cross-section. As a further example, with reference to FIG. 18B, indentation 55 in cross-section has a substantially linear incision portion reaching from a lower exterior area of upper plate 51 to a small, hollow circular portion within upper plate 51. In another example, with reference to FIG. 18C, indentation 55 in cross-section is generally water-droplet-shaped, having a hollow portion within upper plate 51 that tapers in a curving manner and ends, with edge areas 56 touching each other, at an exterior of upper plate 51. Generally, indentations 55 may have any cross-sectional shape, and this shape may result in portions of upper plate 51 immediately adjacent to and on opposite sides of indentations 55 being separated, touching, or exhibiting any mixed configuration incorporating separated portions and touching portions. An advantage to this general configuration is that opposite sides of indentations 55 make contact to prevent outward flexing of upper plate 51, thereby resisting outward expansion and retaining an intended shape of chamber 33.

Figure 18D:
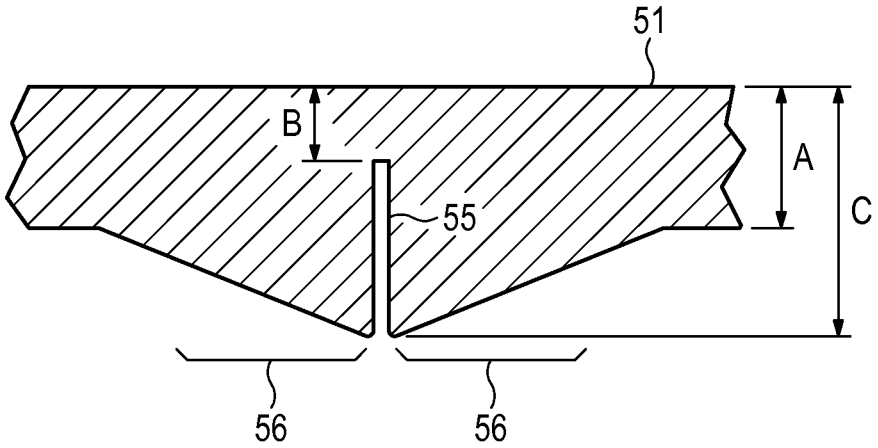
Figure 18E:
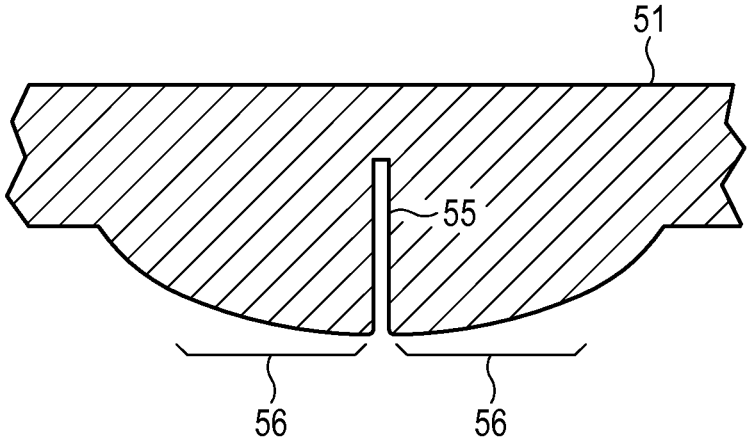
Figure 18F:
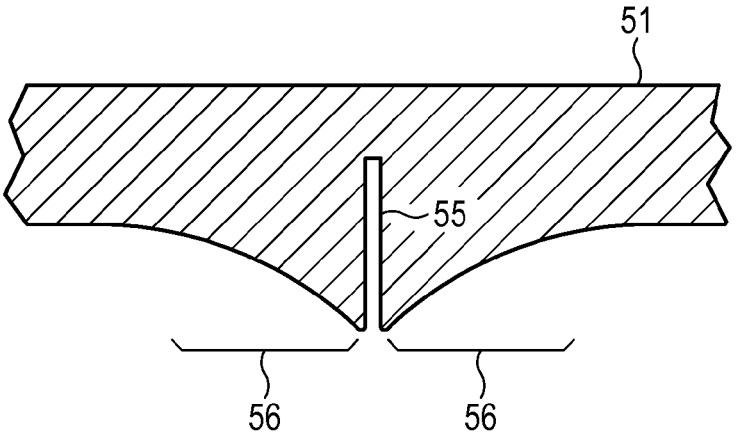

Edge areas 56 may also have other cross-sectional configurations. In the initial configuration of upper plate 51, the thickness of upper plate 51 is substantially uniform outside of indentations 55, even at areas immediately adjacent to and on opposite sides of indentations 55. That is, edge areas 56 are substantially flush with other areas of upper plate 51 outside of indentations 55. In further configurations, edge areas 56 have a greater thickness than other portions of upper plate 51 spaced away from edge areas 56. In such configurations, the cross-sectional profile from edge areas 56 to portions of upper plate 51 spaced away from edge areas 56 may take any shape. For example, with reference to FIG. 18D, when tracing the cross-sectional profile from edge areas 56 to portions of upper plate 51 spaced away from edge areas 56, the thickness of upper plate 51 may decrease substantially linearly. As a further example, with reference to FIG. 18E, the thickness of upper plate 51 may decrease slowly at first, then decrease rapidly until reaching the thickness of the remainder of upper plate 51. In another example, with reference to FIG. 18F, the thickness of upper plate 51 may decrease rapidly at first, then decrease slowly until reaching the thickness of the remainder of upper plate 51. Generally, edge areas 56, and the profile of upper plate 51 between indentations 55 and portions spaced away from edge areas 56, may have any cross-sectional shape. Each of these configurations also have an advantage of resisting outward expansion and retaining an intended shape of chamber 33.

In the initial configuration, a first thickness of upper plate 51 at an area spaced away from indentations 55 is greater than a second thickness of upper plate 51 measured within indentations 55. In further configurations, a third thickness of upper plate 51 measured at edge areas 56 may be greater than the first thickness of upper plate 51, where the first thickness is at an area spaced away from both indentations 55 and edge areas 56. For example, with reference to FIG. 18D, a first thickness A, a second thickness B, and a third thickness C are defined. Third thickness C of upper plate 51, which is measured at edge areas 56, may be two or more times greater than first thickness A of upper plate 51, which is measured at an area spaced away from indentations 55 and edge areas 56. Additionally, third thickness C, measured at edge areas 56, is greater than both first thickness A and second thickness B. The protruding aspect of portions of upper plate 51 having third thickness C (i.e., the areas corresponding with edge areas 56) provides an advantage of resisting outward expansion and retaining an intended shape of chamber 33.

In some configurations, edge areas 56 may be outward protrusions in an outer exterior side of upper plate 51, located on opposite sides of, and immediately adjacent to, indentations 55. In such configurations, edge areas 56 may serve to restrict the rotation of a first portion of upper plate 51 about indentations 55 with respect to a second portion of upper plate 51. In other configurations, either or both of edge areas 56 may serve as a hinge stop, obstructing flexing of upper plate 51 in one direction while permitting flexing of upper plate 51 in another direction. A hinge stop may have a first portion located on one side of indentations 55 and a second portion located on an opposite side of indentations 55. Alternatively, a hinge stop may be one-sided, or may be solely located on one side of indentations 55. Accordingly, the protruding aspect of portions of upper plate 51 having third thickness C (i.e., the areas corresponding with edge areas 56) provides an advantage of resisting outward expansion and retaining an intended shape of chamber 33.

Figure 18G:
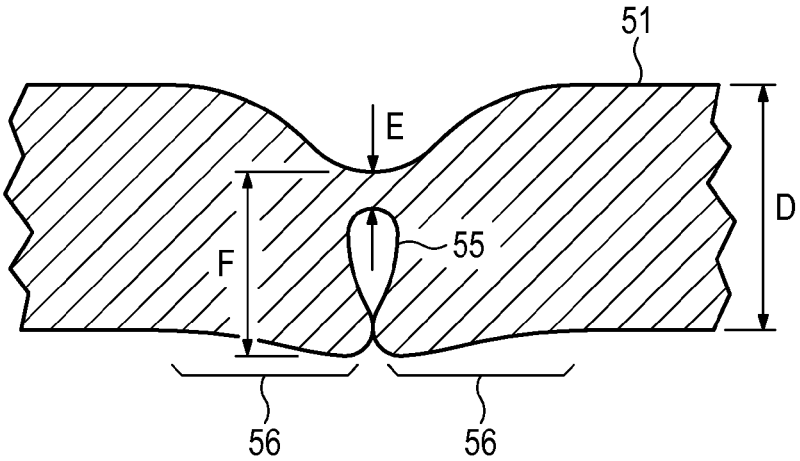

In the initial configuration of upper plate 51, a thickness at indentations 55 is defined by a lower surface of upper plate 51. However, in further configurations, a thickness at indentations 55 may be defined by both an upper surface of upper plate 51 and a lower surface of upper plate 51. For example, with reference to FIG. 18G, a first thickness D, a second thickness E, and a third thickness F are defined, and second thickness E of upper plate 51 at indentations 55 is defined both by the shape of an upper surface of upper plate 51 and the shape of a lower surface of upper plate 51. In such configurations, first thickness D may be greater than third thickness F.

Generally, the cross-sectional configuration of indentations 55 and edge areas 56 may vary along a length of indentations 55 and edge areas 56. That is, the cross-sectional configuration of indentations 55 and edge areas 56 may not be uniform along the entire length of indentations 55 and edge areas 56, but may differ across the entire length, resulting in indentations 55 and edge areas 56 including a variety of cross-sectional configurations. For example, a depth of indentations 55, or a width of indentations 55, or both may vary along a length of indentations 55 and edge areas 56.

Figure 19A:
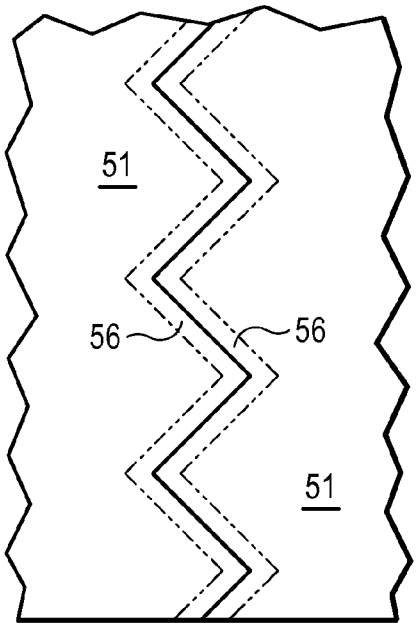
FIGS. 19A-19C are partial bottom plan views of further configurations of the upper plate.
Figure 19B:
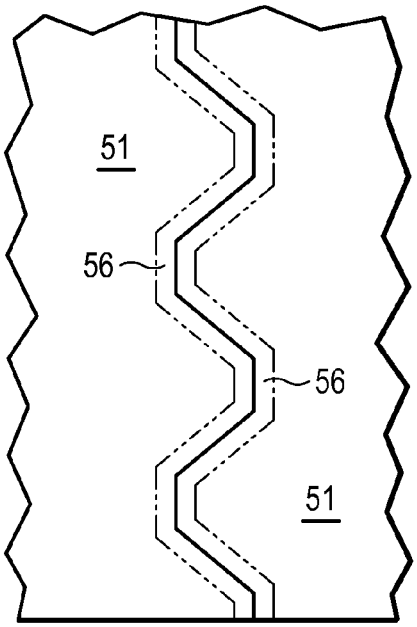
Figure 19C:
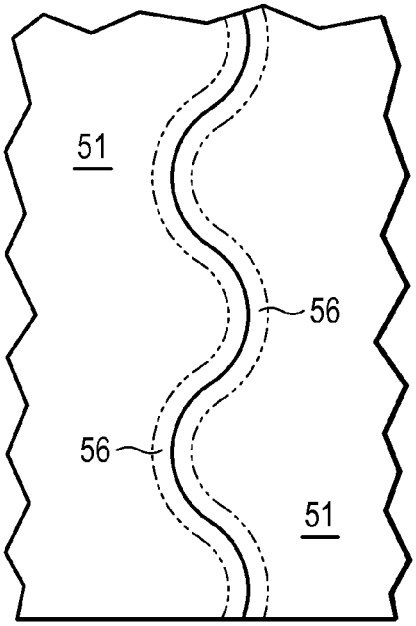

Edge areas 56 may exhibit further configurations while running generally parallel to corresponding substantially straight indentations 55, as may be seen from a bottom plan perspective. In the initial configuration, edge areas 56 are formed to be substantially straight, and are parallel to substantially straight indentations 55. However, in further configurations, edge areas 56 may be otherwise formed. For example, with reference to FIG. 19A, edge areas 56 may be formed to have a triangular or saw-toothed configuration closely following substantially straight corresponding indentations 55. As a further example, with reference to FIG. 19B, edge areas 56 may be formed to have a trapezoidally-shaped configuration closely following substantially straight corresponding indentations 55. In another example, with reference to FIG. 19C, edge areas 56 may be formed to have a curving, circular, rippling, or otherwise wavy configuration closely following substantially straight corresponding indentations 55. Additionally, with reference to FIGS. 19A-19C, edge areas 56 may have an interlocking configuration, which may restrict the movement of edge areas 56 with respect to each other, or which may establish and maintain an alignment, or a positional relationship, between opposite edge areas 56. An advantage of maintaining an alignment of opposite edge areas 56 is that a hemorrhaging or distortion of chamber 33 in the area associated with the opposite edge areas 56 may be reduced or prevented. Generally, in closely following corresponding indentations 55, edge areas 56 may have configurations incorporating any shape or shapes, regular or irregular, periodically instantiated or continuously instantiated, whether under a regular pattern or no pattern.

These further cross-sectional configurations of indentations 55, variations in thickness of edge areas 56, and configurations of edge areas 56 may be combined. For example, with reference to FIG. 20, in some configurations of upper plate 51, (a) indentations 55 may have a generally water-droplet-shaped cross-section, (b) when tracing the cross-sectional profile from edge areas 56 to portions of upper plate 51 spaced away from edge areas 56, the thickness of upper plate 51 may decrease rapidly at first, then decrease slowly toward the thickness of the remainder of upper plate 51, and (c) edge areas 56 may be formed to have a curving, circular, rippling, or otherwise wavy configuration. In other configurations, any cross-sectional configuration of indentations 55 and any cross-sectional configuration of edge areas 56 may be combined, and in such combinations, edge areas 56 may additionally be formed to have any configuration closely following substantially straight corresponding indentations 55.

Figure 21A:
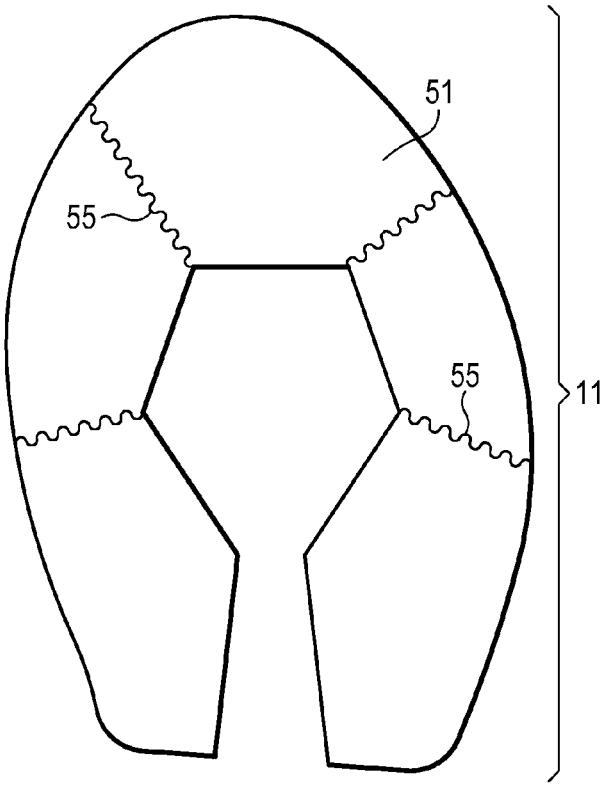
FIGS. 21A-21C are bottom plan views of further configurations of the upper plate.
Figure 21B:
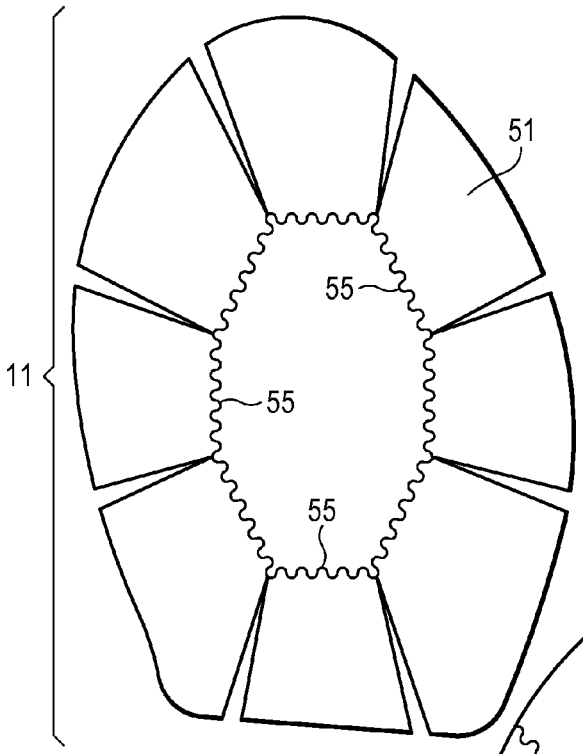
Figure 21C:
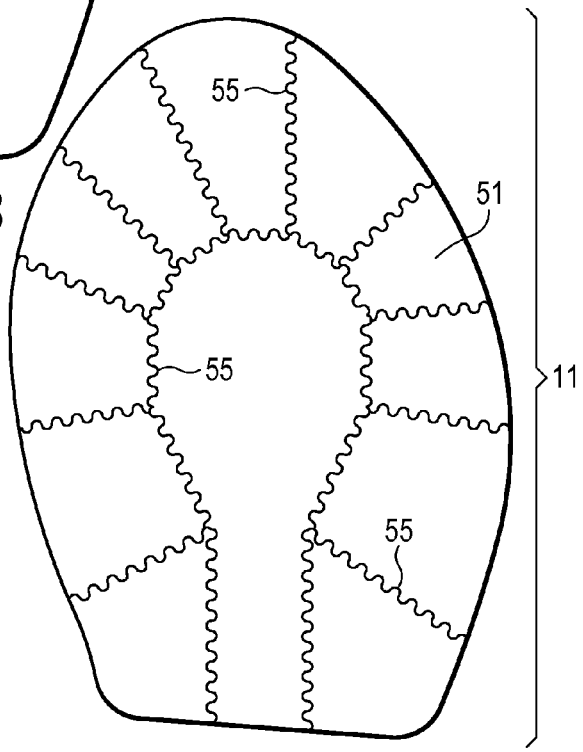
Figure 22A:
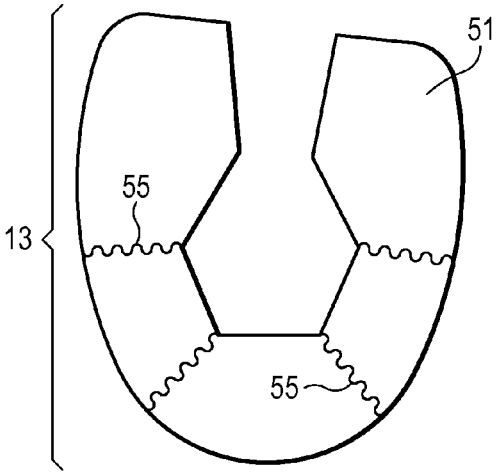
FIGS. 22A-22C are bottom plan views of further configurations of the upper plate.
Figure 22B:
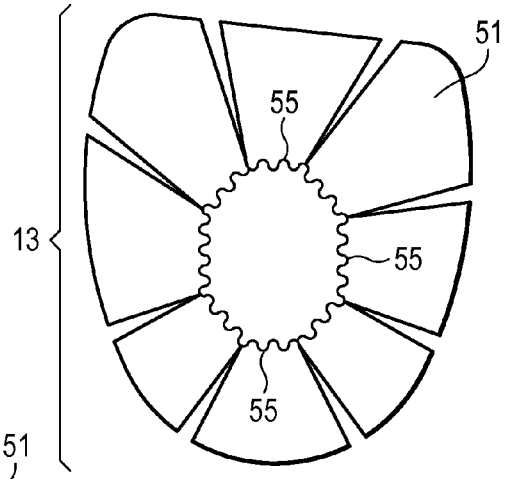
Figure 22C:
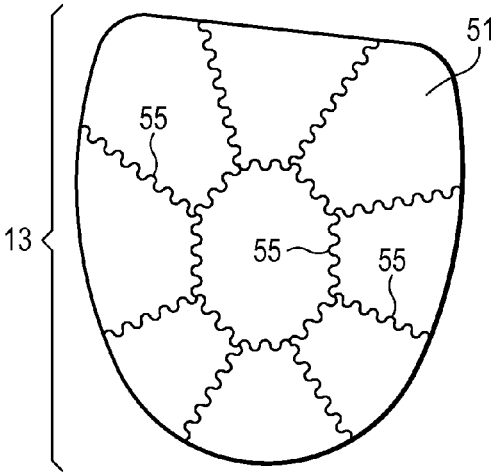

Chamber 33 may have one or more upper plates 51 or lower plates 52, which may have various shapes. In the initial configuration, upper plate 51 and lower plate 52 have a shape corresponding with a general outline of the foot. However, upper plate 51 may instead have a shape corresponding with a portion of the foot. Upper plate 51 may extend across at least fifty percent of chamber 33. For example, with reference to FIGS. 21A-21C, upper plate 51 in some configurations has a shape corresponding with portions of forefoot region 11 and midfoot region 12 of the foot. Alternatively, with reference to FIGS. 22A-22C, upper plate 51 in some configurations has a shape corresponding with portions of midfoot region 12 and heel region 13 of the foot. Generally, upper plate 51 or lower plate 52 may have a shape corresponding with any region or regions of the foot. Additionally, more than one upper plate 51 or lower plate 52 may be incorporated into the same chamber 33, and may be spaced apart from other upper plates 51 or lower plates 52, respectively, within chamber 33.

Chamber 33 may itself have other configurations. In the initial configuration, chamber 33 has a shape corresponding with a general outline of the foot. In further configurations, however, chamber 33 may have a substantially circular shape, or a filled-in U-shape similar to the shape of a heel, or a shape having a central area from which lobes extend radially outward. In configurations in which upper plate 51 or lower plate 52 correspond in shape with a portion of the foot, chamber 33 may correspond in shape with the same portion of the foot. In general, chamber 33 may have any shape corresponding with one or more portions of the foot.

Figure 23:
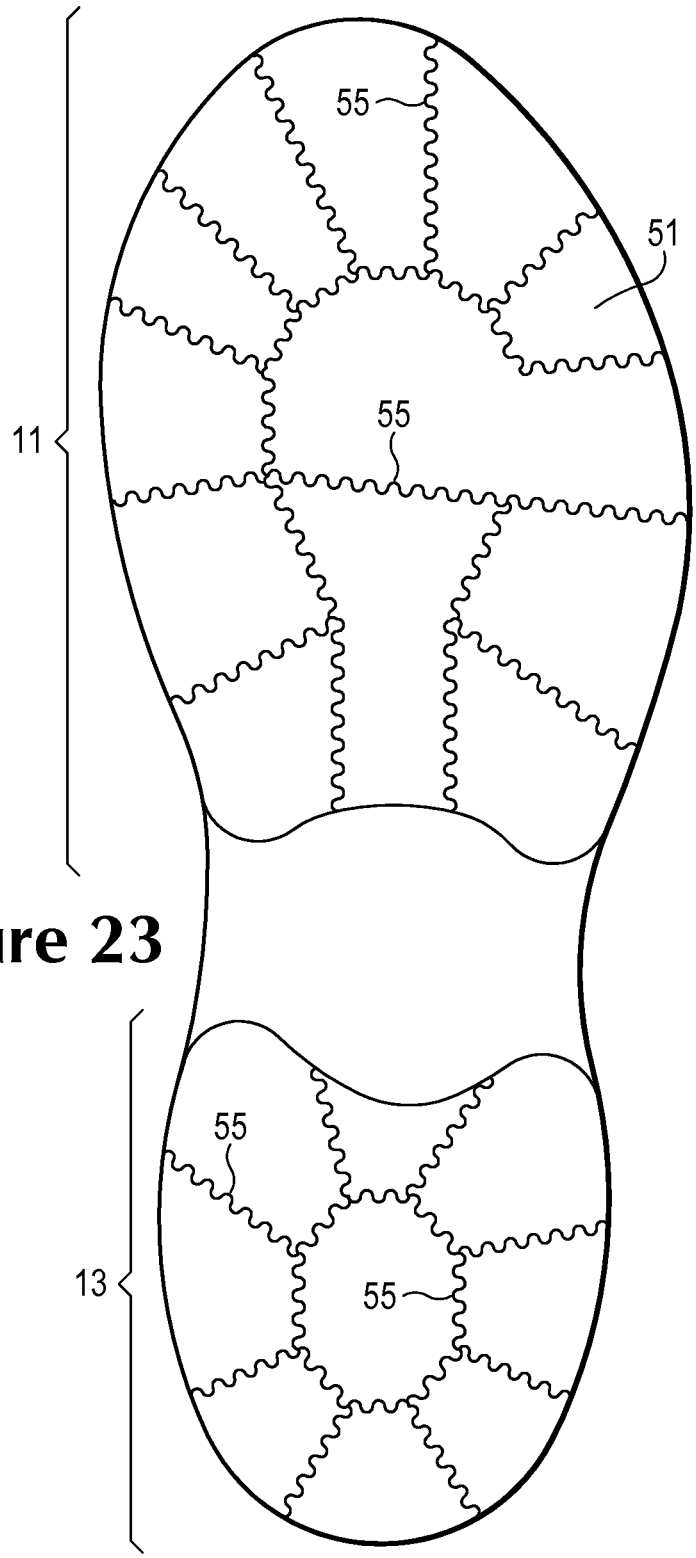
FIG. 23 is a bottom plan view of a further configuration of the upper plate.

In the initial configuration, indentations 55 are substantially linear and extend across upper plate 51. However, indentations 55 may generally extend across any portion of upper plate 51 or lower plate 52. For example, with reference to FIGS. 21A and 22A, upper plate 51 has a roughly U-shaped configuration, and indentations 55 demarcate and exist between sections of upper plate 51 along the U-shaped configuration. As a further example, with reference FIGS. 21B and 22B, upper plate 51 has a central portion and separate radial portions, and indentations 55 exist between each radial portion and the central portion. In another example, with reference to FIGS. 21C and 22C, upper plate 51 has a central portion and a roughly U-shaped portion which includes radial portions, and indentations 55 demarcate and exist both between sections of upper plate 51 along the U-shaped configuration, and between each radial portion and the central portion. In a further example yet, with reference to FIG. 23, upper plate 51 has a shape corresponding with a general outline of the foot. In a portion of forefoot region 11 and midfoot region 12 of upper plate 51, indentations 55 demarcate and exist between sections of upper plate 51. Similarly, in a portion of heel region 13 and midfoot region 12 of upper plate 51, indentations 55 demarcate and exist between sections of upper plate 51.

In the initial configuration, indentations 55 have a configuration of single lines. However, in further configurations, indentations 55 may have a configuration of two or more lines intersecting at any angle. For example, with reference to FIGS. 21C, 22C, and 23, indentations 55 may have a configuration of three lines meeting at one point in a Y-shape or a T-shape. Generally, an indentation 55 may include any plurality of supplemental indentations, which may extend radially outward from indentation 55 in any manner.

Indentations 55 may be incorporated in a variety of ways in the various surfaces of upper plates 51 and lower plates 52. In the initial configuration, indentations 55 are defined in a lower surface of upper plate 51. In contrast, for example, with reference to FIG. 24A, indentations 55 are defined in a lower surface of lower plate 52. As a further example, with reference to FIG. 24B, indentations 55 are defined both in a lower surface of upper plate 51 and a lower surface of lower plate 52, and indentations 55 in lower plate 52 are positioned similarly to indentations 55 in upper plate 51. In another example, with reference to FIG. 24C, indentations 55 are defined both in a lower surface of upper plate 51 and a lower surface of lower plate 52, but indentations 55 in lower plate 52 are positioned differently than indentations 55 in upper plate 51.

Additionally, upper plates 51 may be positioned in an upper area of either an interior surface or an exterior surface of chamber 33, and lower plates 52 may be positioned in a lower area of either an interior surface or an exterior surface of chamber 33. In the initial configuration, upper plate 51 is secured to an interior surface or lower surface of upper barrier portion 41, and lower plate 52 is secured to an interior surface or upper surface of lower barrier portion 42. In contrast, for example, with reference to FIG. 24D, lower plate 52 is secured to an exterior surface or lower surface of lower barrier portion 42.

In the initial configuration, upper plate 51 and lower plate 52 are substantially planar. However, in further configurations, upper plate 51 or lower plate 51 may not be substantially planar, but may have contours, indentations, protrusions, or shaping. For example, upper plate 51 may be contoured or shaped to better correspond to the shape of the lower surface of a foot, such as by incorporating a depression in heel region 13.

Figure 20:
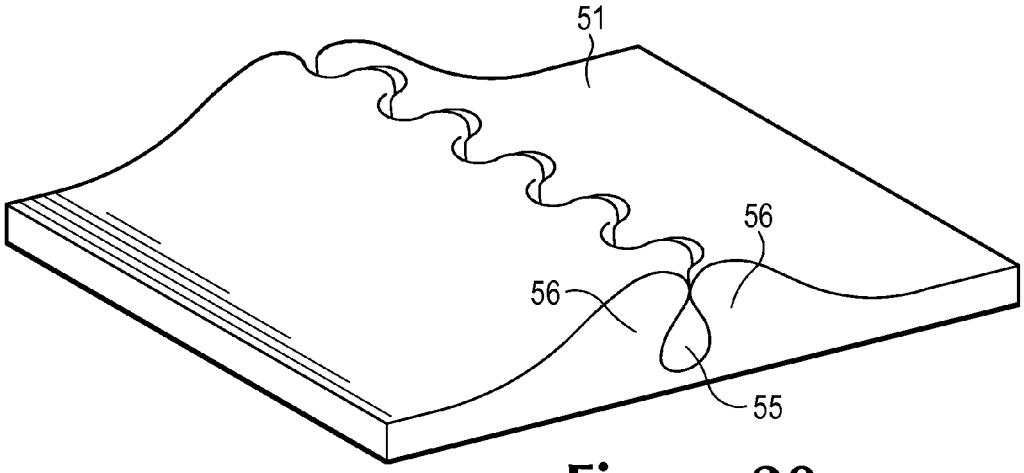
FIG. 20 is a perspective view of a portion of a further configuration of the upper plate.

With reference to FIG. 24E, by being flexible in one direction, an upper plate 51 having a configuration similar to the configuration depicted in FIG. 20 may allow for compression of chamber 33 in the presence of downward pressure 92. Meanwhile, with reference to FIG. 24F, by locking in the reverse direction, upper plate 51 may restrict outward distention of chamber 33 in the presence of outward pressure 91. Accordingly, in various configurations, the incorporation of upper plate 51 or lower plate 52 into fluid-filled chamber 33 may impart shape-retention properties to chamber 33 in the absence of internal bonds, linkages, or connections between upper barrier portion 41 and lower barrier portion 42, while retaining properties relating to attenuating ground reaction forces (i.e., cushioning). Additionally, with fewer such internal structures visible, upper plate 51 or lower plate 52 may enhance an overall transparency or see-through quality of chamber 33. Alternatively, in some configurations, upper plate 51 or lower plate 52 may be incorporated into chambers that also include other internal structures, such as internal bonds, linkages, or connections. In such configurations, the incorporation of upper plate 51 or lower plate 52 into fluid-filled chamber 33 may impart shape-retention properties in some areas of chamber 33 without other internal structures, and may enhance an overall transparency or see-through quality of corresponding portions of chamber 33.

The invention is disclosed above and in the accompanying figures with reference to a variety of configurations. The purpose served by the disclosure, however, is to provide an example of various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. A fluid-filled structure comprising:

a chamber with (a) an exterior surface and (b) an interior surface located opposite the exterior surface, at least a portion of the interior surface defining a cavity within the chamber that receives a fluid; and a plate having (a) a first surface secured to an upper area of the interior surface of the chamber and (b) a second surface located opposite the first surface, at least the second surface defining a flexion area extending across at least a portion of the plate, and the second surface defining a flexion stop located adjacent to the flexion area, a bending of the plate at the flexion area being blocked in one direction by the flexion stop, wherein the plate has (a) a first thickness at an area spaced away from the flexion area, (b) a second thickness within the flexion area, and (c) a third thickness at the flexion stop, the third thickness being greater than the first thickness and the second thickness.

2. The fluid-filled structure recited in claim 1, wherein the flexion stop has an interlocking configuration.

3. The fluid-filled structure recited in claim 2, wherein the flexion stop has a wavy configuration.

4. The fluid-filled structure recited in claim 1, wherein the second surface defines another flexion area extending across at least a portion of the plate.

5. The fluid-filled structure recited in claim 1, wherein the flexion area is defined by both the first surface and the second surface.

6. The fluid-filled structure recited in claim 1, wherein a supplemental plate is located within the cavity and secured to the interior surface of the chamber.

7. The fluid-filled structure recited in claim 6, wherein the plate and the supplemental plate are secured to opposite sides of the chamber.

8. The fluid-filled structure recited in claim 1, wherein the chamber is formed from a polymer material with a first stiffness and the plate is formed from a polymer material with a second stiffness, the first stiffness being less than the second stiffness.

9. The fluid-filled structure recited in claim 1, wherein the flexion area is a living hinge.

10. A fluid-filled structure comprising:

a chamber with (a) an exterior surface and (b) an interior surface located opposite the exterior surface, at least a portion of the interior surface defining a cavity within the chamber that receives a fluid; and a plate located within the cavity, the plate having (a) a first surface secured to the chamber and (b) a second surface located opposite the first surface, the second surface defining an indentation extending into and across at least a portion of the plate, and the second surface defining edge areas located immediately adjacent to the indentation and on opposite sides of the indentation, at least a portion of the edge areas having an interlocking configuration and being in contact with each other, and the indentation having a hollow portion within the plate, wherein the plate has a first thickness between the first surface and the second surface in an area spaced from the indentation, and the plate has a second thickness between the first surface and the second surface within the indentation, the first thickness being greater than the second thickness.

11. The fluid-filled structure recited in claim 10, wherein the plate is secured to the interior surface of the chamber.

12. The fluid-filled structure recited in claim 11, wherein the plate is secured to an upper area of the interior surface of the chamber.

13. The fluid-filled structure recited in claim 10, wherein the first thickness is at least two times the second thickness.

14. The fluid-filled structure recited in claim 10, wherein the plate has a third thickness between the first surface and the second surface in the edge areas, the third thickness being greater than the first thickness.

15. The fluid-filled structure recited in claim 14, wherein the third thickness is at least two times the first thickness.

16. The fluid-filled structure recited in claim 10, wherein the edge areas are protrusions.

17. The fluid-filled structure recited in claim 10, wherein the edge areas have a wavy configuration.

18. The fluid-filled structure recited in claim 10, wherein the second surface defines another indentation extending across at least a portion of the plate.

19. The fluid-filled structure recited in claim 10, wherein at least a portion of the indentation has a Y-shaped configuration.

20. The fluid-filled structure recited in claim 10, wherein a plurality of supplemental indentations extend radially outward from a central area of the plate to a peripheral area of the plate.

21. The fluid-filled structure recited in claim 10, wherein a supplemental plate is located within the cavity and secured to the interior surface of the cavity.

22. The fluid-filled structure recited in claim 21, wherein the plate and the supplemental plate are secured to opposite sides of the chamber.

23. The fluid-filled structure recited in claim 10, wherein the chamber is formed from a polymer material with a first stiffness and the plate is formed from a polymer material with a second stiffness, the first stiffness being less than the second stiffness.

24. An article of footwear having an upper and a sole structure secured to the upper, the sole structure comprising:

a chamber with (a) an exterior surface and (b) an interior surface located opposite the exterior surface, at least a portion of the interior surface defining a cavity within the chamber that receives a fluid; and a plate located within the cavity, the plate having (a) a first surface secured to the interior surface of the chamber and (b) a second surface located opposite the first surface, the second surface defining an indentation extending into and across at least a portion of the plate, a thickness between the first surface and the second surface within the indentation being non-zero, and the indentation having a hollow portion within the plate, wherein the plate has a first thickness between the first surface and the second surface in an area spaced from the indentation, and the plate has a second thickness between the first surface and the second surface within the indentation, the first thickness being at least two times the second thickness.

25. The article of footwear recited in claim 24, wherein the chamber has (a) an upper portion positioned adjacent to the upper of the footwear, (b) a lower portion positioned adjacent to a ground-engaging surface of the footwear, and a sidewall portion that that extends between the upper portion and the lower portion, the plate being secured to the upper portion of the chamber.

26. The article of footwear recited in claim 25, wherein the plate extends adjacent to at least fifty percent of the upper portion of the chamber.

27. The article of footwear recited in claim 25, wherein another plate is located within the cavity and secured to the lower portion of the chamber.

28. The article of footwear recited in claim 24, wherein the plate has a third thickness between the first surface and the second surface in areas immediately adjacent to the indentation and on opposite sides of the indentation, the third thickness being at least two times the first thickness.

29. The article of footwear recited in claim 24, wherein areas of the second surface of the plate protrude outward on opposite sides of the indentation to form a hinge stop obstructing a flexing of the plate in a first direction and permitting a flexing of the plate in a second direction.

30. The article of footwear recited in claim 29, wherein the hinge stop includes a first portion located on one side of the indentation and a second portion located on an opposite side of the indentation, at least a portion of the first portion and the second portion having an interlocking configuration.

31. The article of footwear recited in claim 24, wherein the chamber is formed from a polymer material with a first stiffness and the plate is formed from a polymer material with a second stiffness, the first stiffness being less than the second stiffness.

32. An article of footwear having an upper and a sole structure secured to the upper, the sole structure comprising:

a chamber defining an interior cavity that receives a pressurized fluid, the chamber extending from (a) a heel region of the footwear to a forefoot region of the footwear and (b) a lateral side of the footwear to a medial side of the footwear, the chamber having (a) an upper portion that forms an upper surface of the chamber and is positioned adjacent to the upper, (b) a lower portion that forms an opposite lower surface of the chamber and is positioned adjacent to a ground-contacting surface of the sole structure, and (c) a sidewall portion that that extends between the upper portion and the lower portion to form a sidewall of the chamber, a plate secured to the upper portion of the chamber and extending from (a) the heel region to the forefoot region and (b) the lateral side to the medial side, the plate having a first area and a second area located on opposite sides of a flexion line, the first area rotating relative to the second area about the flexion line, wherein the flexion line is an area of the plate with a non-zero thickness less than a thickness of the first area and a thickness of the second area, and wherein the plate has (a) a first thickness in the first area, (b) a second thickness at the flexion line, and (c) a third thickness in a portion of the first area immediately adjacent to the flexion line, the first thickness being at least two times the second thickness, and the third thickness being at least two times the first thickness, and wherein the rotation of the first area relative to the second area is obstructed in one direction by portions of the first area and second area immediately adjacent to the flexion line.

33. The article of footwear recited in claim 32, wherein the plate extends adjacent to at least fifty percent of the upper portion of the chamber.

34. The article of footwear recited in claim 32, wherein another plate is located within the cavity and secured to the lower portion of the chamber.

35. The article of footwear recited in claim 32, wherein each of the first area and the second area define protruding portions locating on opposite sides of the flexion line and immediately adjacent to the flexion line.

36. The article of footwear recited in claim 35, wherein at least part of the protruding portions have an interlocking configuration.

37. The article of footwear recited in claim 35, wherein at least part of the protruding portions have an interlocking and wavy configuration.

38. The article of footwear recited in claim 32, wherein the chamber is formed from a polymer material with a first stiffness and the plate is formed from a polymer material with a second stiffness, the first stiffness being less than the second stiffness.

* * * * *